US009073337B2

(12) United States Patent
Iwata

(10) Patent No.: US 9,073,337 B2
(45) **Date of Patent: *Jul. 7, 2015**

(54) LIQUID EJECTING APPARATUS AND METHOD OF CIRCULATING LIQUID

(75) Inventor: Yuji Iwata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 33 days.

This patent is subject to a terminal disclaimer.

(21) Appl. No.: 13/614,040

(22) Filed: Sep. 13, 2012

(65) Prior Publication Data

US 2013/0241979 A1 Sep. 19, 2013

(30) Foreign Application Priority Data

Sep. 20, 2011 (JP) ..... 2011-204918

(51) Int. Cl.
*B41J 29/38* (2006.01)
*B41J 2/18* (2006.01)
*B41J 2/175* (2006.01)

(52) U.S. Cl.
CPC ... *B41J 2/18* (2013.01); *B41J 2/175* (2013.01)

(58) Field of Classification Search
CPC ..... B41J 2/16523
USPC ..... 347/6, 7, 89
See application file for complete search history.

(56) References Cited

U.S. PATENT DOCUMENTS 4,607,261 A 8/1986 McCann et al.
4,680,696 A 7/1987 Ebinuma et al.
6,000,792 A 12/1999 Koizumi et al.
6,039,442 A * 3/2000 Hagiwara et al. ..... 347/89
2007/0291086 A1 12/2007 Murakami et al.
2009/0009541 A1 1/2009 Shimazaki
2009/0135927 A1 5/2009 Prakash
2009/0167826 A1 7/2009 Ishizawa et al.
2009/0201347 A1 8/2009 Hamano
2009/0231368 A1 9/2009 Nakano et al.
2009/0303283 A1 12/2009 Nakano et al.
2009/0315927 A1* 12/2009 Uehara ..... 347/7
2010/0007951 A1 1/2010 Bramstedt et al.
2010/0079511 A1* 4/2010 Murakami et al. ..... 347/6
2010/0085396 A1 4/2010 Yokota et al.

(Continued)

FOREIGN PATENT DOCUMENTS

EP 2305475 4/2011
GB 2447919 10/2008

(Continued)

OTHER PUBLICATIONS

Extended European Search Report dated Dec. 7, 2012 for European Patent Application No. 12184819.6.

(Continued)

*Primary Examiner* — Lam Nguyen
(74) *Attorney, Agent, or Firm* — Workman Nydegger

(57) ABSTRACT

A liquid ejecting apparatus includes a storage unit which stores liquid, a head unit which ejects the liquid onto a medium, a plurality of supply flow paths which supplies the liquid to the head unit from the storage unit, a plurality of bypass flow paths which straddles the supply flow paths which are different from each other, and a controller which circulates the liquid in a circulating flow path which is configured only by the supply flow path and the bypass flow path among the storage unit, the head unit, the supply flow path, and the bypass flow path.

4 Claims, 18 Drawing Sheets

(56) References Cited

U.S. PATENT DOCUMENTS

| | | | |
|---|---|---|---|
| 2010/0283808 | A1 | 11/2010 | Terakado et al. |
| 2011/0115844 | A1 | 5/2011 | Ozawa |
| 2011/0267406 | A1 | 11/2011 | Hanson |

FOREIGN PATENT DOCUMENTS

| | | |
|---|---|---|
| JP | 60-137655 | 7/1985 |
| JP | 3106013 | 9/2000 |
| JP | 2011-110853 | 6/2011 |

OTHER PUBLICATIONS

European Search Report dated Feb. 28, 2013 for European Patent No. 12197728.4.

* cited by examiner

LIQUID EJECTING APPARATUS AND METHOD OF CIRCULATING LIQUID

BACKGROUND

1. Technical Field

The present invention relates to a liquid ejecting apparatus, and a method of circulating a liquid.

2. Related Art

A liquid ejecting apparatus which includes a storage unit which stores a liquid, a head unit which ejects a liquid onto a medium, and a plurality of supply flow paths which supplies the liquid to the head unit from the storage unit has been well known. As the liquid ejecting apparatus, for example, an ink jet printer which performs printing by ejecting ink onto various media such as paper, or a film.

Japanese Patent No. 3106013 is an example of the related art.

Meanwhile, in the related art, there has been a disadvantage of settling of components in the liquid due to liquid stagnation in the supply flow path for supplying the liquid from a storage unit to a head unit.

SUMMARY

An advantage of some aspects of the invention is to make the liquid in the supply flow path flow using a simple configuration.

According to an aspect of the invention, there is provided a liquid ejecting apparatus which includes a storage unit which stores liquid; a head unit which ejects the liquid onto a medium; a plurality of supply flow paths which supplies the liquid to the head unit from the storage unit; a plurality of bypass flow paths which straddles the supply flow paths which are different from each other; and a controller which circulates the liquid in a circulating flow path which is configured only by the supply flow path and the bypass flow path from among the storage unit, the head unit, the supply flow path, and the bypass flow path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
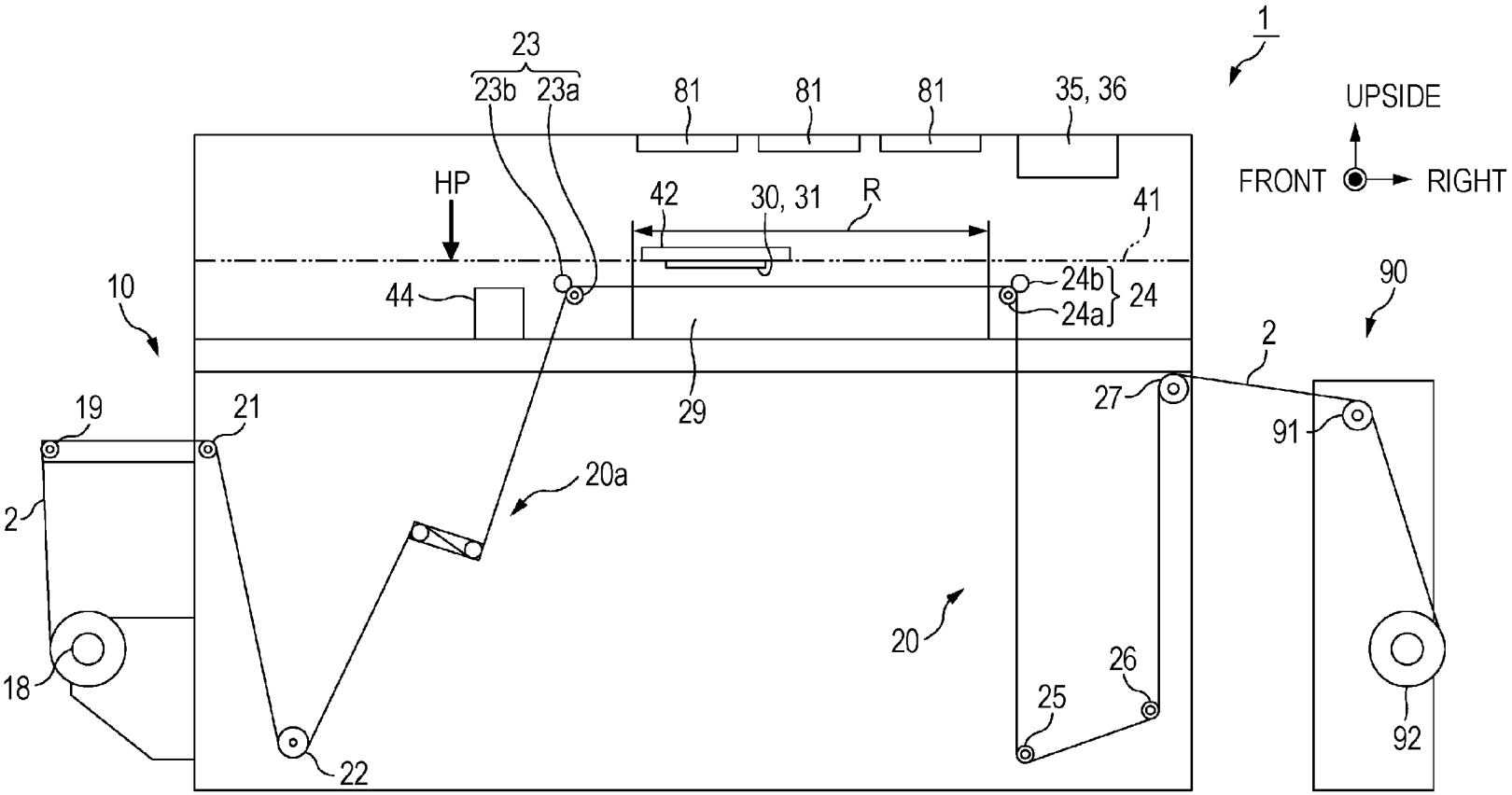
FIG. 1 is a schematic diagram which illustrates a configuration of an image recording apparatus.

At least the following will be clarified by descriptions of the present specification and accompanying drawings.

According to an aspect of the invention, there is provided a liquid ejecting apparatus which includes a storage unit which stores liquid; a head unit which ejects the liquid onto a medium; a plurality of supply flow paths which supplies the liquid to the head unit from the storage unit; a plurality of bypass flow paths which straddles the supply flow paths which are different from each other; and a controller which circulates the liquid in a circulating flow path which is configured only by the supply flow path and the bypass flow path from among the storage unit, the head unit, the supply flow path, and the bypass flow path.

In the liquid ejecting apparatus, it is possible to make liquid in the supply flow path flow using a simple configuration.

It is preferable that the liquid ejecting apparatus include three or more supply flow paths, and the circulating flow path be configured such that the plurality of bypass flow paths does not straddle between the two supply flow paths with respect to any set of two supply flow paths among three or more supply flow paths.

In this case, it is possible to appropriately perform filling of a liquid into the bypass flow path.

It is preferable that the liquid ejecting apparatus further include a first supply flow path, a second supply flow path, a third supply flow path, and a fourth supply flow path as the three or more supply flow paths; a first bypass flow path which straddles the first supply flow path and the second supply flow path; a second bypass flow path which straddles the second supply flow path and the third supply flow path; a third bypass flow path which straddles the third supply flow path and the fourth supply flow path; and a fourth bypass flow path which straddles the fourth supply flow path and the first supply flow path, in which the circulating flow path is configured by the first supply flow path, the first bypass flow path, the second supply flow path, the second bypass flow path, the third supply flow path, the third bypass flow path, and the fourth supply flow path and the fourth bypass flow path.

In this case, it is possible to make the length of the bypass flow paths short.

It is preferable that the liquid ejecting apparatus include a cableveyor which causes the first to fourth supply flow paths to be trained, the first bypass flow path and the third bypass flow path be provided between the cableveyor and the storage unit which is outside of the cableveyor, and the second bypass flow path and the fourth bypass flow path be provided between the cableveyor and the head unit which is outside of the cableveyor.

In this case, it is possible to make the liquid in the supply flow path flow over a wide range.

According to another aspect of the invention, there is provided a method of circulating liquid which includes preparing for a liquid ejecting apparatus including a storage unit which stores liquid, a head unit which ejects the liquid onto a medium, a plurality of supply flow paths which supplies the liquid to the head unit from the storage unit, and a plurality of bypass flow paths which straddles the supply flow paths which are different from each other; and circulating the liquid in a circulating flow path which is configured only by the supply flow path and the bypass flow path among the storage unit, the head unit, the supply flow path, and the bypass flow path.

In the method of circulating liquid, it is possible to make the liquid in the supply flow path flow using a simple configuration.

Regarding Configuration Example of Image Recording Apparatus 1

A configuration example of an image recording apparatus 1 as an example of a liquid ejecting apparatus (an ink jet printer in the embodiment) will be described using FIGS. 1 and 2. FIG. 1 is a schematic cross-sectional view of the image recording apparatus 1, and FIG. 2 is a block diagram of the image recording apparatus 1.

In addition, in the following description, when the "the vertical direction", or "the horizontal direction" are referred to, the direction is based on the direction which is illustrated in FIG. 1 by the arrows. In addition, when referring to "front-back direction", the direction denotes the direction which is orthogonal to the paper plane in FIG. 1.

In addition, according to the embodiment, as an example of a medium on which an image is recorded by the image recording apparatus 1, a sheet which is wound in a roll shape (hereinafter, referred to as a rolled paper (continuous paper)) will be described.

Figure 2:
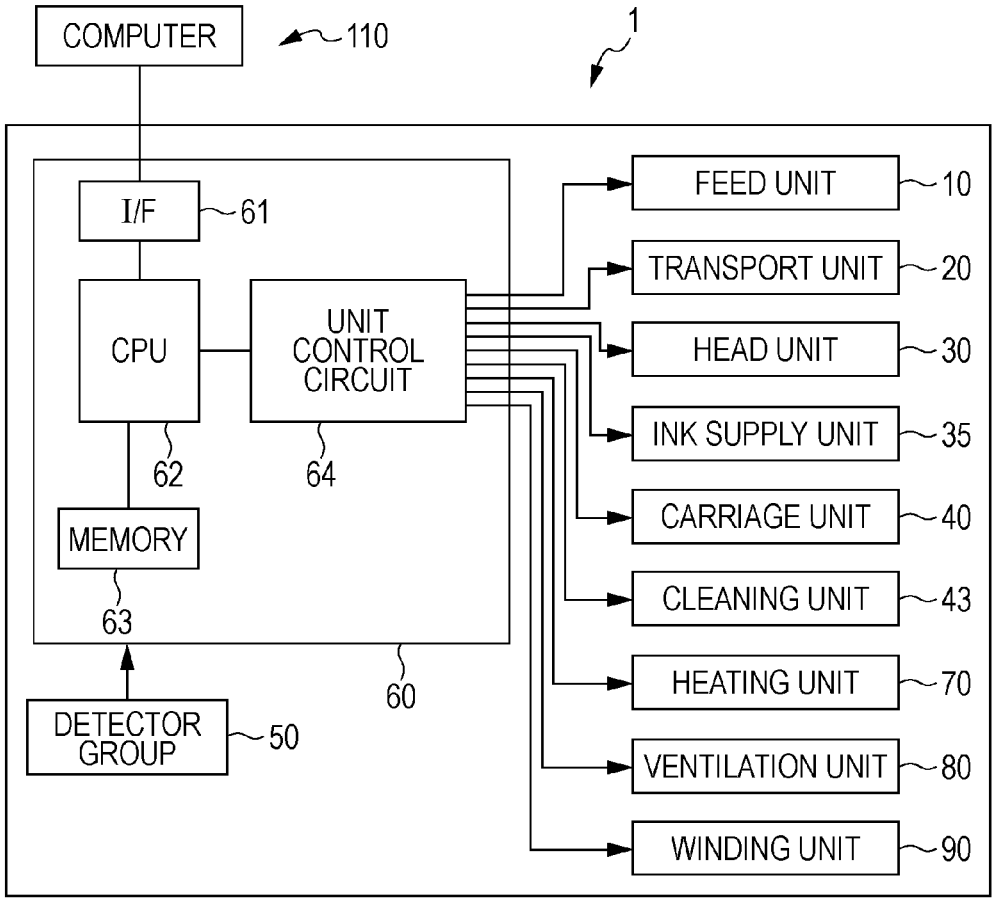
FIG. 2 is a block diagram which illustrates the configuration of the image recording apparatus.

As shown in FIGS. 1 and 2, the image recording apparatus 1 according to the embodiment includes a transport unit 20, a feed unit 10, a platen 29, a winding unit 90 along a transport path at which the rolled paper 2 is transported by the transport unit 20 (in FIG. 1, the transport path is denoted by a portion between a winding shaft 18 and a winding driving shaft 92 at which the rolled paper 2 is located), and further includes a head unit 30 which performs image recording by ejecting ink as an example of a liquid in an image recording region R on the transport path, an ink supply unit 35, a carriage unit 40, a cleaning unit 43, a heating unit 70, a ventilation unit 80 which sends wind to the rolled paper 2 on the platen 29, a controller 60 which is in charge of operations as the image recording apparatus 1 by controlling these units or the like, and a detector group 50.

The feed unit 10 is a unit which feeds the rolled paper 2 to the transport unit 20. The feed unit 10 includes the winding shaft 18 at which the rolled paper 2 is wound, and is rotatably supported, and a relay roller 19 which guides the rolled paper 2 which is paid out from the winding shaft 18 to the transport unit 20 by winding the rolled paper up.

The transport unit 20 is a unit which transports the rolled paper 2 which is sent by the feed unit 10 along the preset transport path. As shown in FIG. 1, the transport unit 20 includes a relay roller 21 which is located to the right horizontally with respect to the relay roller 19, a relay roller 22 which is located at the obliquely right lower part when seen from the relay roller 21, a first transport roller 23 which is located at the obliquely right upper part when seen from the relay roller (on the upstream side in the transport direction when seen from the platen 29), a steering unit 20*a* which is located between the relay roller 22 and the first transport roller 23, a second transport roller 24 which is located to the right when seen from the first transport roller 23 (on the downstream side in the transport direction when seen from the platen 29), a reversing roller 25 which is located vertically downwards when seen from the second transport roller 24, and a relay roller 26 which is located to the right when seen from the reversing roller 25, and a sending-out roller 27 which is located upwards when seen from the relay roller 26.

The relay roller 21 is a roller which loosens the rolled paper 2 which is sent from the relay roller 19 downward by winding the rolled paper up from the left side.

The relay roller 22 is a roller which transports the rolled paper 2 which is sent from the relay rollers 21 toward the right slant upper part by winding the rolled paper up from the left side.

The first transport roller 23 includes a first driving roller 23*a* which is driven by a motor which is not shown, and a first driven roller 23*b* which is arranged so as to face the first driving roller 23*a* with the rolled paper 2 interposed therebetween. The first transport roller 23 is a roller which transports the rolled paper 2 which is loosened toward the lower part to the image recording region R which faces the platen 29 by lifting the rolled paper upwards. The first transport roller 23 temporarily stops transporting while image printing with respect to a portion of the rolled paper 2 on the image recording region R is performed. In addition, a transport amount of the rolled paper 2 which is located on the platen 29 is adjusted when the first driven roller 23*b* is rotated along with rotational driving of the first driving roller 23*a* by a driving control of the controller 60.

As described above, the transport unit 20 includes a mechanism which transports a portion of the rolled paper 2 which is wound between the relay rollers 21, 22 and the first transport roller 23 by loosening the portion of the rolled paper downward. The loosening of the rolled paper 2 is monitored based on a detection signal from a loosening detection sensor (not shown) by the controller 60. Specifically, the portion of the rolled paper 2 which is loosened between the relay rollers 21, 22 and the first transport roller 23 is detected by the loosening detection sensor, the transport unit 20 is able to transport the rolled paper 2 in a state of being loosened, since an appropriate magnitude of tension is applied to the portion. On the other hand, when the loosening detection sensor does not detect the loosened portion of the rolled paper 2, since the portion has an excessive magnitude of tension applied thereto, transport of the rolled paper 2 by the transport unit 20 is temporarily stopped, and the tension is adjusted to an appropriate magnitude.

As shown in FIG. 1, the steering unit 20*a* is a unit which is located on the transport path in a state of being slanted, and changes a position of the rolled paper 2 (position of the rolled paper 2 in the width direction (front-back direction in FIG. 1)) in the width direction by rotating. That is, when the rolled paper 2 is transported along the transport path, there is a case where the position of the rolled paper 2 in the width direction is changed due to a change in the tension which is applied to the rolled paper 2, due to a deviation of shaft, an installation error, or the like of the relay roller or the like. In addition, the steering unit 20*a* is a unit for adjusting the position of the rolled paper 2 in the width direction.

The second transport roller 24 includes a second driving roller 24*a* which is driven by a motor which is not shown, and second driven roller 24*b* which is arranged so as to face the second driving roller 24*a* with the rolled paper 2 interposed therebetween. The second transport roller 24 is a roller which transports a portion of the rolled paper 2 after an image being recorded by the head unit 30 along a supporting surface of the platen 29 horizontally to the right, and then transports vertically downwards. In this manner, the transport direction of the rolled paper 2 is switched. In addition, a predetermined tension which is applied to the portion of the rolled paper 2 which is located on the platen 29 is adjusted when the second driven roller 24*b* is rotated along with a rotational driving of the second driving roller 24*a* by a driving control of the controller 60.

The reversing roller 25 is a roller which transports the rolled paper 2 which is sent from the second transport roller 24 toward the obliquely right upper part by winding the rolled paper up from the left upper part.

The relay roller 26 is a roller which transports the rolled paper 2 which is sent from the reversing roller 25 upwards by winding the rolled paper up from the left lower part.

The sending-out roller 27 is a roller which sends the rolled paper 2 which is sent from the relay roller 26 to the winding unit 90 by winding the rolled paper up from the left lower part.

In this manner, the transport path for transporting the rolled paper 2 is formed when the rolled paper 2 is moved by sequentially passing through each roller. In addition, the rolled paper 2 is intermittently transported along the transport path in a region unit corresponding to the image recording region R, by the transport unit 20.

The head unit 30 is a unit which records an image on the portion of the rolled paper 2 which is located at the image recording region R on the transport path. That is, the head unit 30 forms in image by ejecting ink at a portion of the rolled paper 2 which is sent to the image recording region R (on the platen 29) on the transport path, by the transport unit 20. According to the embodiment, the head unit 30 includes fifteen heads 31.

Each head unit 31 includes nozzle columns in which nozzles are aligned in the column direction on the base thereof. According to the embodiment, the nozzle columns which are formed by a plurality of nozzles Nos. 1 to N are respectively included in each color of yellow (Y), magenta (M), cyan (C), black (K), and white (W). Each of nozzles Nos. 1 to N of each nozzle column is linearly arranged in the intersecting direction intersecting the transport direction of the rolled paper 2 (that is, the intersecting direction is the column direction which is described above). Each nozzle column is arranged in parallel along the transport direction having intervals mutually.

Each of nozzles Nos. 1 to N is provided with a piezoelectric element (not shown) as a driving element for ejecting ink droplets. The piezoelectric element deforms a side wall of the ink flow path by expanding according to the application time of a voltage when the voltage of a predetermined time width is applied between electrodes which are provided at both ends of the piezoelectric element. Due to this, the volume of the ink flow path is contracted according to the expansion of the piezoelectric element, and ink corresponding to the amount of contraction is ejected from each of the nozzles Nos. 1 to N of each color as ink droplets.

In addition, the fifteen heads 31 are aligned in the intersecting direction (the column direction), and in this manner, the head unit 30 is formed. For this reason, the head unit 30 includes 15×N nozzles in each color.

The ink supply unit 35 is a unit which supplies ink to the head unit 30 when the amount of ink in the head unit 30 is reduced due to ejecting of ink by the head 31. In addition, the ink supply unit 35 will be described later in detail.

The carriage unit 40 is a unit which moves the head unit 30 (head 31). The carriage unit 40 includes a carriage guide rail 41 (denoted by two dotted dashed line in FIG. 1) which extends in the transport direction (horizontal direction), and a carriage 42 which is supported to be able to reciprocate in the transport direction (horizontal direction), along the carriage guide rail 41, and a motor which is not shown.

The carriage 42 is provided with the head unit 30, that is, the fifteen heads 31. More specifically, the carriage 42 is divided into four sub carriages (first to fourth sub carriages), four heads 31 are provided in the first to third sub carriages, respectively, and three heads 31 are provided in the fourth sub carriage.

In other words, the fifteen heads 31 configure four head groups, that is, a first head group 302 to which the first head to fourth head belong, a second head group 304 to which the fifth head to eighth head belong, a third head group 306 to which the ninth head to twelfth head belong, and a fourth head group 308 to which the thirteenth head to fifteenth head belong. In addition, the first head group 302 is provided in a first sub carriage, the second head group 304 is provided in a second sub carriage, the third head group 306 is provided in a third sub carriage, and the fourth head group 308 is provided in a fourth sub carriage, respectively.

In addition, the carriage 42 which is formed by four carriages is configured so as to move in the transport direction (horizontal direction) in conjunction with the head unit 30 (in other words, four head groups, or the fifteen head units 31) by driving of the motor which is not shown.

The cleaning unit 43 (not shown in FIG. 1) is a unit for cleaning the head 31. The cleaning unit 43 is provided at a home position (Hereinafter, referred to as HP. Please refer to FIG. 1.), and includes a cap (not shown), a suction pump 43*a* (refer to FIG. 4, or the like), or the like. When the head 31 (carriage 42) is located at the HP by moving in the transport direction (horizontal direction), the cap (not shown) comes into close contact with the base (nozzle surface) of the head 31. In this manner, when the suction pump 43*a* is operated in a state where the cap comes into close contact with the base, ink in the head 31 is suctioned along with thickened ink, or paper dust. In this manner, head cleaning is completed when clogged nozzles return from a non-ejecting state. In addition, the cleaning unit 43 is used when performing an ink filling process to be described later.

In addition, a flushing unit 44 is provided between the HP and the platen 29 in the transport direction (horizontal direction), and when the head 31 (carriage 42) is located at a position facing the flushing unit 44 by moving in the transport direction (horizontal direction), the head 31 performs a flushing operation in which flushing is performed by ejecting ink from each nozzle which belongs to the nozzle column.

The platen 29 supports a portion of the rolled paper 2 which is located at the image recording region R on the transport path, and heats the portion. As shown in FIG. 1, the platen 29 is provided corresponding to the image recording region R on the transport path, and is arranged at a region which goes along the transport path between the first transport roller 23 and the second transport roller 24. In addition, the platen 29 can heat the portion of the rolled paper 2 by receiving heat which is generated by the heating unit 70.

The heating unit 70 is a unit which heats the rolled paper 2, and includes a heater which is not shown. The heater includes a nichrome wire, and is configured by arranging the nichrome wire in the platen 29 so as to have a constant distance from the supporting surface of the platen 29. For this reason, in the heater, the nichrome wire itself is heated by being electrically connected, and is possible to conduct heat at a portion of the rolled paper 2 which is located on the supporting surface of the platen 29. Since the heater is configured by building-in the nichrome wire in the entire region of the platen 29, it is possible to uniformly conduct the heat to the portion of the rolled paper 2 on the platen 29. According to the embodiment, the portion of the rolled paper 2 on the platen is uniformly heated so as to have a temperature of 45° C. In this manner, it is possible to dry ink which is landed onto the portion of the rolled paper 2.

The ventilation unit 80 is a unit which sends air to the rolled paper 2 on the platen 29. The ventilation unit 80 includes a fan 81, and a motor (not shown) which rotates the fan 81. The fan 81 dries the ink landed onto the rolled paper 2 by blowing air onto the rolled paper 2 on the platen 29 by rotating. As shown in FIG. 1, a plurality of fans 81 is provided at an openable and closeable cover (not shown) which is provided at the main body. In addition, when the cover is closed, each fan 81 is located at the upper part of the platen 29, and is set so as to face the supporting surface of the platen 29 (rolled paper 2 on the platen 29).

The winding unit 90 is a unit which winds the rolled paper 2 (rolled paper on which image recording is completed) up which is sent by the transport unit 20. The winding unit 90 includes a relay roller 91 which transports the rolled paper 2 which is sent from the sending-out roller 27 to the obliquely right lower part by being wound up from the left upper part, and a winding driving shaft 92 which winds up the rolled paper 2 sent from the relay roller 91 by being rotatably supported.

The controller 60 is a control unit which controls the image recording apparatus 1. As shown in FIG. 2, the controller 60 includes an interface unit 61, a CPU 62, a memory 63, and a unit control circuit 64. The interface unit 61 performs transceiving of data between a host computer 110 as an external device and the image recording apparatus 1. The CPU 62 is an arithmetic processing unit which controls the entire image recording apparatus 1. The memory 63 is a unit which secures a region for storing a program of the CPU 62, a work area, or the like. The CPU 62 controls each unit using the unit control circuit 64 depending on the program which is stored in the memory 63.

The detector group 50 monitors a state in the image recording apparatus 1, and for example, there are the above-described loosening detection sensor, a rotary-type encoder which is used when controlling transporting of the rolled paper 2 by being attached to the transport roller, a sheet detection sensor which detects the presence of the transported rolled paper 2, a linear-type encoder which detects a position of the carriage 42 (or head 31) in the transport direction (vertical direction), a sheet end position detection sensor which detects a position of the sheet end (edge) of the rolled paper 2 in the width direction, a sub-tank sensor to be described later, or the like.

Regarding Ink Supply Unit 35

Regarding Configuration Example of Ink Supply Unit 35

Figure 3:
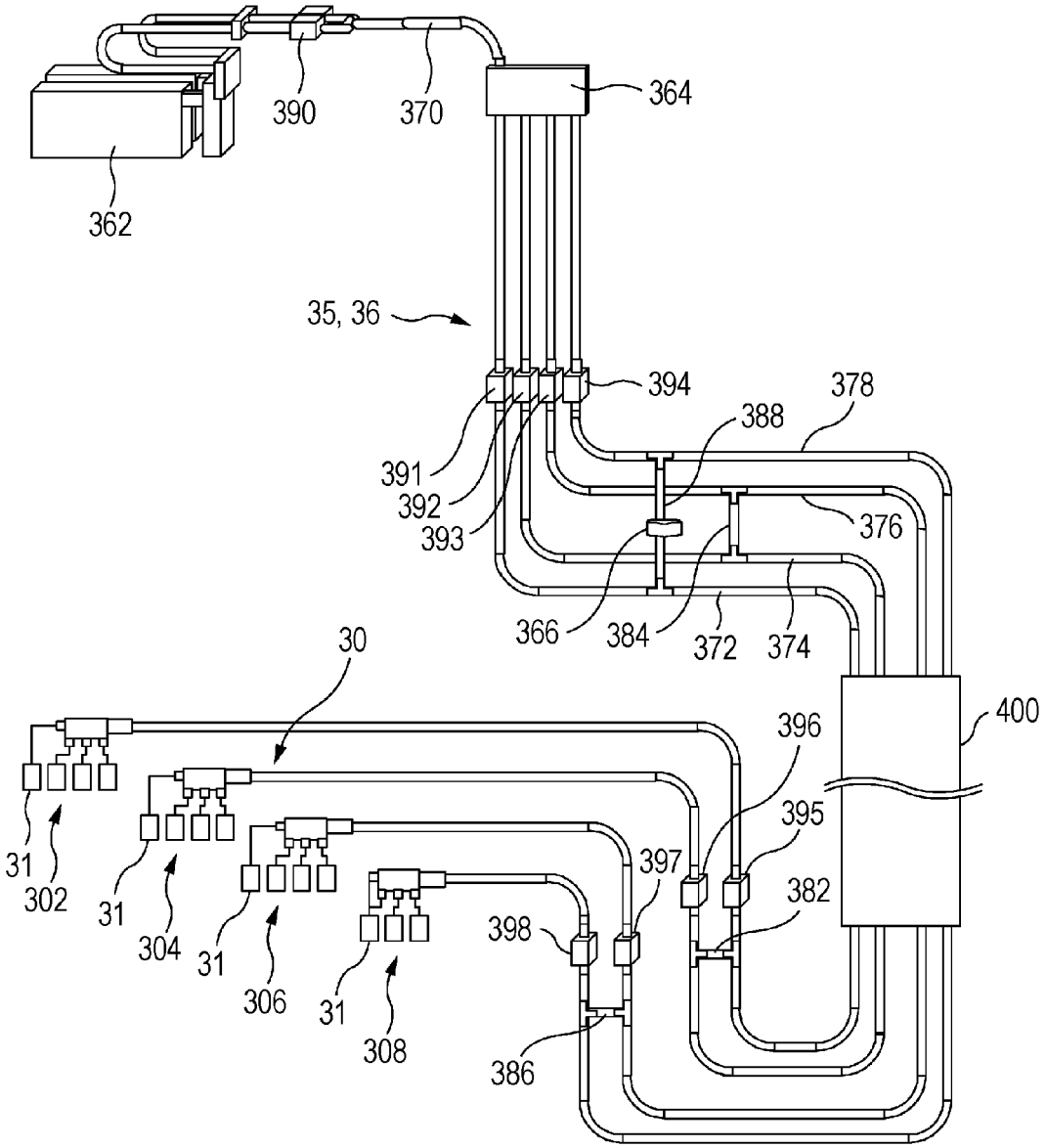
FIG. 3 is a schematic diagram which illustrates a white ink supply unit.
Figure 4:
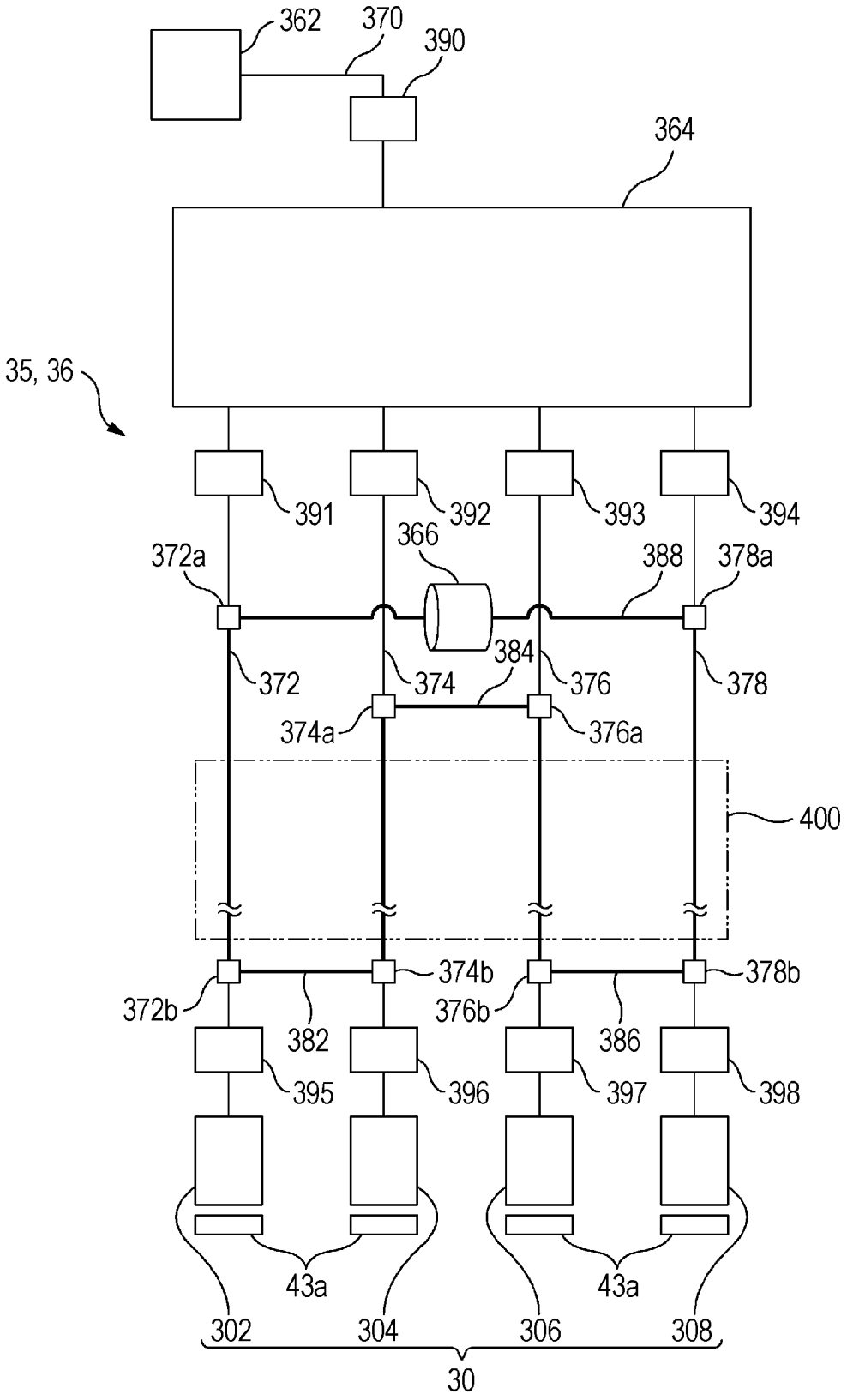
FIG. 4 is a block diagram of the white ink supply unit.

Next, the ink supply unit 35 will be described using FIGS. 1, 3, and 4. FIG. 3 is a schematic diagram which illustrates the white ink supply unit 36. FIG. 4 is a block diagram which illustrates the white ink supply unit 36. In addition, FIG. 4 is a diagram in which FIG. 3 is illustrated as a block diagram in order to be easily viewed. FIGS. 3 and 4 illustrate the same unit (descriptions thereof will be made using FIG. 4).

As described above, the ink supply unit 35 is a unit which supplies ink to the head unit 30 when the amount of ink in the head unit 30 is reduced due to ejecting of ink by the head 31.

The ink supply unit 35 is provided for each ink color. That is, a yellow ink supply unit for supplying yellow ink, a magenta ink supply unit for supplying magenta ink, a cyan ink supply unit for supplying cyan ink, a black ink supply unit for supplying black ink, a white ink supply unit 36 for supplying white ink, and the like are provided.

Here, the white ink supply unit 36 has a configuration which is different from those of the ink supply units of other colors than white (on the other hand, ink supply units of other colors than white have a common configuration), though the reason will be described later. Hereinafter, the white ink supply unit 36 will be mainly described among the plurality of ink supply units 35, and the ink supply units of other colors will be described later only for differences in configuration from the white ink supply unit 36.

As shown in FIG. 4, the white ink supply unit 36 includes an ink cartridge 362, a sub-tank 364 as an example of a storage unit which stores ink, a plurality of tubes as ink flow paths, a plurality of valves (according to the embodiment, the valves are solenoid valves, however, it is not limited to this) which opens and closes the tube, and a pump 366 (according to the embodiment, the pump is tube pump, however, it is not limited to this). In addition, places where the ink cartridge 362 and the sub-tank 364 are provided are denoted using reference numerals 35 and 36 in FIG. 1.

The ink cartridge 362 accommodates ink to be supplied to the head unit 30. The ink cartridge 362 is configured so as to be detachable from the main body of the image recording apparatus.

In addition, as shown in FIG. 4, the ink cartridge 362 is connected to the sub-tank 364 through a tube connecting the ink cartridge 362 and the sub-tank 364 (the tube is referred to as inter-IC-ST tube 370, for convenience).

The sub-tank 364 is a tank which temporarily stores ink which is supplied to the head unit 30 from the ink cartridge 362. The sub-tank 364 is fixed to the main body of the image recording apparatus. That is, the sub-tank 364 has a configuration of not being detachable from the main body of the image recording apparatus, different from the ink cartridge 362.

In addition, the sub-tank 364 which is connected to the ink cartridge 362 through the inter-IC-ST tube 370 has already been described, however, as shown in FIG. 4, the inter-IC-ST tube 370 is provided with a valve (the valve is referred to as inter-IC-ST valve 390, for convenience). Further, the sub-tank 364 is provided with a sub-tank sensor (not shown) which detects that the amount of ink in the sub-tank 364 becomes less than a threshold value.

In addition, when the controller 60 perceives that the amount of ink in the sub-tank 364 is less than the threshold value by receiving a detection signal from the sub-tank sensor, the controller opens the inter-IC-ST valve 390 which is closed, and causes ink to flow into the sub-tank 364 from the ink cartridge 362. In this manner, the amount of ink is controlled so that a greater amount of ink than the threshold value is present (to be stored) at all times in the sub-tank 364.

In addition, as shown in FIG. 4, the sub-tank 364 is connected to the head unit 30 through four supply tubes which connect the sub-tank 364 and the head unit 30. The four supply tubes (first supply tube 372, second supply tube 374, third supply tube 376, and fourth supply tube 378) fulfill roles as supply flow paths which supply ink to the head unit 30 from the sub-tank 364.

That is, when ink is ejected from the head unit 30 (head 31) by performing image recording (printing) or the like, and ink in the head unit 30 (head 31) is consumed, ink in the sub-tank 364 flows into the head unit 30 (head 31) through the first to fourth supply tubes 372 to 378, in order to replenish the consumed ink.

In addition, as described above, the head unit 30 according to the embodiment includes fifteen heads 31, and the fifteen heads 31 include four head groups, that is, a first head group 302 to a fourth head group 308, however, as shown in FIG. 4, each of the four supply tubes is connected to each of the four head groups, respectively.

That is, the first supply tube 372 (corresponding to the second supply flow path) is connected to the first head group 302 (first head to fourth head), and supplies ink to the first head to fourth head. In addition, the second supply tube 374 (corresponding to the third supply flow path) is connected to the second head group 304 (fifth head to eighth head), and supplies ink to the fifth head to eighth head. In addition, the third supply tube 376 (corresponding to the fourth supply flow path) is connected to the third head group 306 (ninth head to twelfth head), and supplies ink to the ninth head to twelfth head. Further, the fourth supply tube 378 (corresponding to the first supply flow path) is connected to the fourth head group 308 (thirteenth head to fifteenth head), and supplies ink to the thirteenth head to fifteenth head.

In addition, as is clear in FIG. 1, the sub-tank 364 of the ink supply unit 35 and the head unit 30 are located far from each other. For this reason, each of the first to fourth supply tubes 372 to 378 is configured as an extremely long tube, and the length is 5 to 6 meters. In addition, as shown in FIG. 4, a cableveyor 400 which causes the first to fourth supply tubes 372 to 378 to be trained is provided, and the first to fourth supply tubes 372 to 378 are accommodated in the cableveyor 400.

In addition, as shown in FIG. 4, a bypass tube straddles the supply tubes which are different from each other. More specifically, four bypass tubes (first bypass tube 382 to fourth bypass tube 388) are provided, the first bypass tube 382 (corresponding to second bypass flow path) straddles the first supply tube 372 and the second supply tube 374, the second bypass tube 384 (corresponding to third bypass flow path) straddles the second supply tube 374 and the third supply tube 376, the third bypass tube 386 (corresponding to fourth bypass flow path) straddles the third supply tube 376 and the fourth supply tube 378, and the fourth bypass tube 388 (corresponding to first bypass flow path) straddles the fourth supply tube 378 and the first supply tube 372.

In addition, each of the first to fourth bypass tubes 382 to 388 is formed with an extremely short tube, different from the first to fourth supply tubes 372 to 378, and the length thereof is 5 to 20 cm.

In addition, as shown in FIG. 4, both the second bypass tube 384 and the fourth bypass tube 388 are located at positions which are closer to the sub-tank 364 between the sub-tank 364 and the head unit 30. On the other hand, both the first bypass tube 382 and the third bypass tube 386 are located at positions which are closer to the head unit 30 between the sub-tank 364 and the head unit 30. In other words, the second bypass tube 384 (corresponding to third bypass flow path), and the fourth bypass tube 388 (corresponding to first bypass flow path) are provided between the cableveyor 400 and the sub-tank 364 which is the outside of the cableveyor 400, and the first bypass tube 382 (corresponding to second bypass flow path) and the third bypass tube 386 (corresponding to fourth bypass flow path) are provided between the cableveyor 400 and the head unit 30 which is outside of the cableveyor 400.

In addition, the bypass tubes are provided in order to circulate ink in the circulating flow path which is configured by the supply tube and the bypass tube, in order to improve disadvantage in which ink stagnates in the supply tube, and components of the ink settle.

That is, by providing the bypass tube, a closed flow path is formed, which is configured by the first supply tube 372 and the first bypass tube 382, the second supply tube 374 and the second bypass tube 384, the third supply tube 376 and the third bypass tube 386, and the fourth supply tube 378 and the fourth bypass tube 388 (the closed flow path is denoted by a thick line in FIG. 4. In addition, for convenience, the thick line denotes the closed flow path in FIG. 4, and has nothing to do with the thickness of the tube). That is, the formed closed flow path is configured only by the supply tube and bypass tube among the sub-tank 364, the head unit 30, the supply tube, and the bypass tube.

In addition, the pump 366 for causing the ink to flow to the closed flow path is provided in the tube (according to the embodiment, the tube is fourth bypass tube 388, however, it is not limited to this), and when the pump 366 is operated, the closed flow path becomes the circulating flow path, and the ink in the circulating flow path circulates (due to the circulation of ink, disadvantage related to settling is improved).

In addition, as shown in FIG. 4, each of the four supply tubes is provided with two valves (valve on sub-tank side, and valve on head unit side), accordingly, eight valves in total are provided in the supply tube.

That is, as the valve on the sub-tank side, a first sub-tank side valve 391 is provided between a first connection unit 372*a* to which the fourth bypass tube 388 is connected and the sub-tank 364 in the first supply tube 372, a second sub-tank side valve 392 is provided between a second connection unit 374*a* to which the second bypass tube 384 is connected and the sub-tank 364 in the second supply tube 374, a third sub-tank side valve 393 is provided between a third connection unit 376*a* to which the second bypass tube 384 is connected and the sub-tank 364 in the third supply tube 376, and a fourth sub-tank side valve 394 is provided between a fourth connection unit 378*a* to which the fourth bypass tube 388 is connected and the sub-tank 364 in the fourth supply tube 378, respectively.

In addition, as the valve on the head unit side, a first head unit side valve 395 is provided between a fifth connection unit 372*b* to which the first bypass tube 382 is connected and the head unit 30 in the first supply tube 372, a second head unit side valve 396 is provided between a sixth connection unit 374*b* to which the first bypass tube 382 is connected and the head unit 30 in the second supply tube 374, a third head unit side valve 397 is provided between a seventh connection unit 376*b* to which the third bypass tube 386 is connected and the head unit 30 in the third supply tube 376, and a fourth head unit side valve 398 is provided between an eighth connection unit 378*b* to which the third bypass tube 386 is connected and the head unit 30 in the fourth supply tube 378, respectively.

In addition, the reason why these valves on the sub-tank side and the valves on the head unit side are provided will be clarified later.

Regarding Circulating Process of Ink in which Ink is circulated

Figure 5:
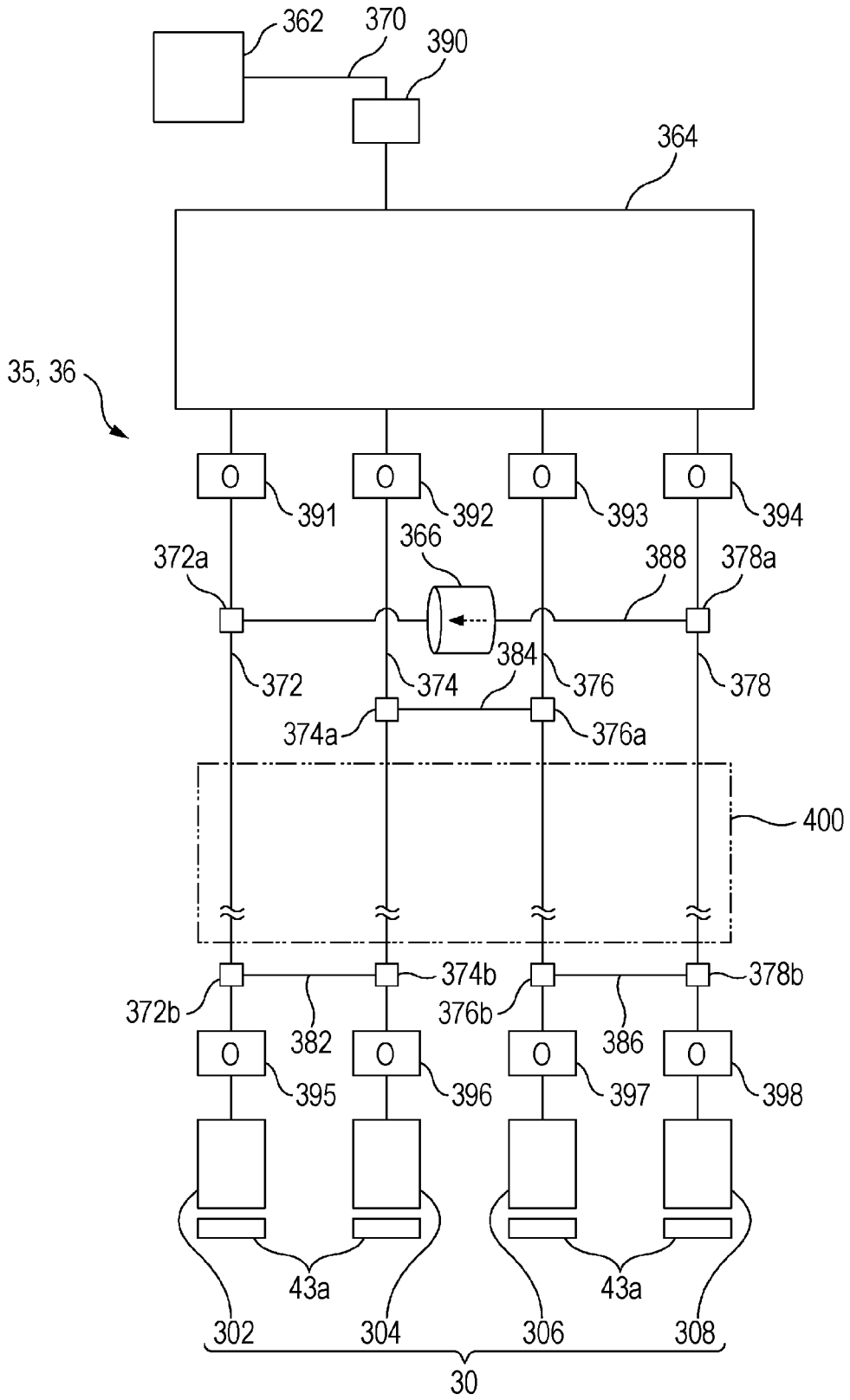
FIG. 5 is a block diagram which illustrates the white ink supply unit before executing an ink circulation process.
Figure 6:
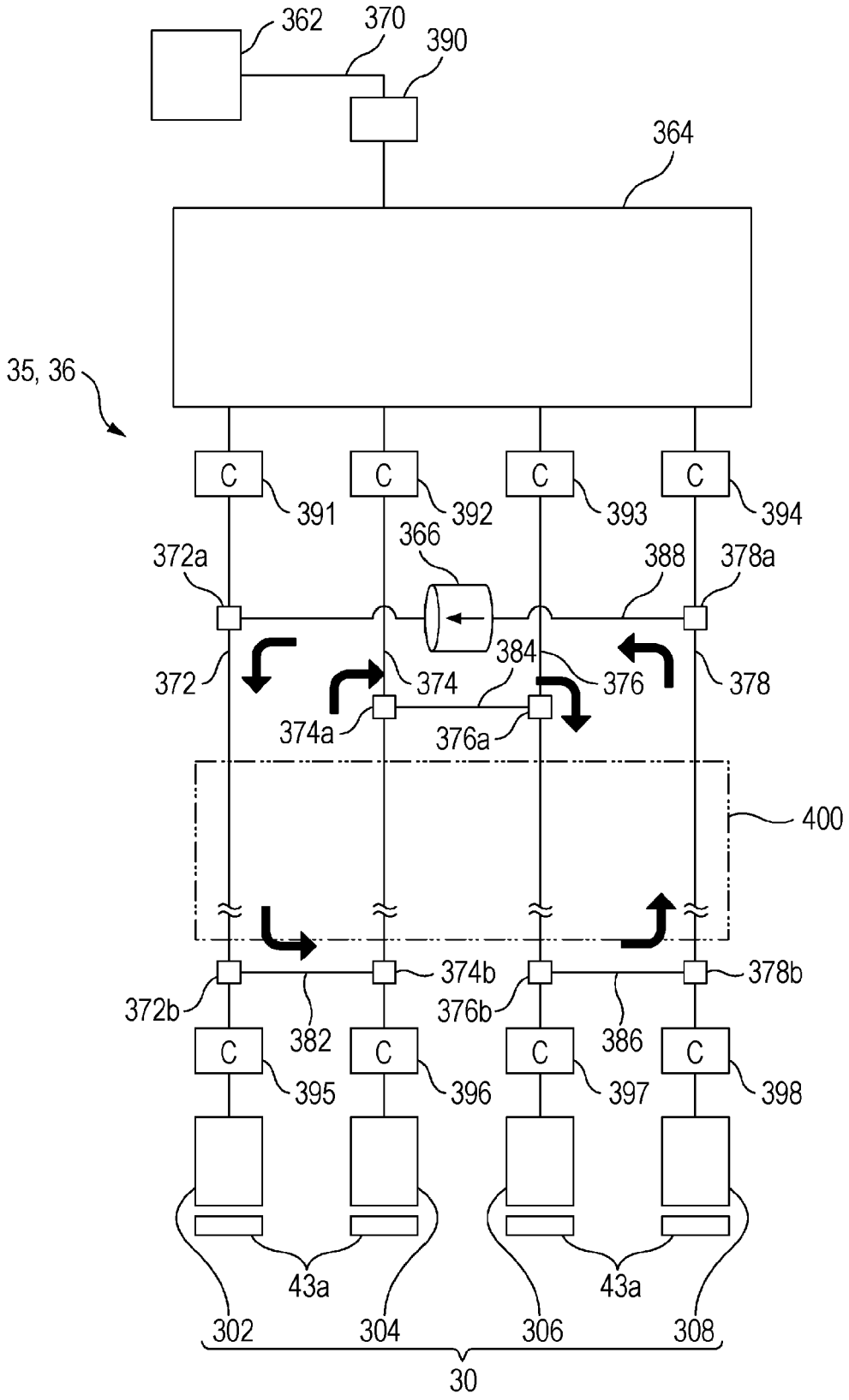
FIG. 6 is a block diagram which illustrates the white ink supply unit when the ink circulation process is performed.

Subsequently, process of circulating ink in the circulating flow path (referred to as ink circulating process, for convenience) will be described using FIGS. 5 and 6. FIG. 5 is a block diagram which illustrates the white ink supply unit 36 before executing the ink circulating process. FIG. 6 is a block diagram which illustrates the white ink supply unit 36 which is being executed with the ink circulating process.

As described above, when ink stagnates in the supply tube (that is, first to fourth supply tubes 372 to 378), a phenomenon (disadvantage) in which components of the ink settle may occur. In addition, when the phenomenon occurs, there is a problem in that image quality is deteriorated since ink which lacks the components is ejected to the rolled paper 2.

In addition, the phenomenon frequently occurs when the image recording apparatus 1 is not used for a long time. For this reason, according to the embodiment, the ink circulating process is set so as to be executed when a power supply is turned on.

FIG. 5 illustrates the white ink supply unit 36 before executing the ink circulating process, that is, the white ink supply unit 36 right after the power supply is turned on. At this time, as shown in FIG. 5, the valves on the sub-tank side and the valves on the head unit side are open ("O" denotes "open valve"), and the pump 366 is not operated (dotted lined arrow denotes "non-operating pump"). In addition, since the image recording apparatus 1 is not used when the power supply is turned off, ink stagnates in the first to fourth supply tubes 372 to 378 and the components of the ink settle.

In addition, in this state, the ink circulating process is performed by the controller 60. That is, the controller 60 circulates ink in the circulating flow path which is configured only by the supply tube and the bypass tube. In addition, according to the embodiment, the controller 60 performs the following in order to execute the process.

That is, as shown in FIG. 6, the controller 60 operates the pump 366 (solid arrow denotes "pumping operation"). In addition, in this manner, ink is circulated in the circulating flow path, and the disadvantage of settling of components of ink is improved. For this reason, it is possible to prevent the image quality from deteriorating.

In addition, when circulating the ink in the circulating flow path, as shown in FIG. 6, the controller 60 closes the first to fourth sub-tank side valves 391 to 394 ("C" denotes "closed valve") so that the circulating is smoothly performed, and in order to completely prevent the sub-tank 364 from being adversely influenced when ink moves due to the circulating.

In addition, similarly, as shown in FIG. 6, the controller 60 closes the first to fourth head unit side valves 395 to 398 so that the circulating is smoothly performed, and in order to completely prevent the head unit 30 from being adversely influenced when ink moves due to the circulating.

In addition, it has been already described that the ink circulating process is for improving the phenomenon (disadvantage) of settling of the components of ink, however, the phenomenon (disadvantage) more frequently occurs in the white ink compared to other inks. That is, since color components of the white ink include heavy materials such as titanium oxide, the pigment components tend to settle remarkably.

For this reason, according to the embodiment, the circulating process is performed only for the white ink. Accordingly, only the white ink supply unit 36 is provided with the bypass tube, the pump 366, and the head unit side valves, and the ink supply unit 35 of other colors are not provided with the above units (sub-tank side valves are provided to the ink supply unit 35 of other colors, as well, since sub-tank side valves are for other uses).

However, it is also possible to perform the circulating process with respect to the ink of other colors, and to provide the ink supply unit 35 of other colors with the bypass tube, the pump 366, and the head unit side valves, as well, without being limited to the above descriptions.

Regarding Ink Filling Process in which Fills Ink

As described above, when ink is ejected from the head unit 30 (head 31), and the ink in the head unit 30 is consumed by performing image recording (printing) or the like, ink in the sub-tank 364 flows into the head unit 30 through the first to fourth supply tubes 372 to 378 in order to replenish the consumed ink, however, when air (bubble) is included in the first to fourth supply tubes 372 to 378, there is a possibility of the air (bubble) flowing into the head unit 30 together with the ink, and adversely influences the image recording (printing).

Therefore, in order to suppress the disadvantage, an ink filling process is performed such that air (bubble) is not present in the first to fourth tubes 372 to 378, by filling the first to fourth tubes 372 to 378 in advance.

In addition, according to the embodiment, filling process with respect to the bypass tube is performed, as well, (naturally, only the white ink supply unit 36 is the target of the filling process), considering that the bypass tubes are provided. That is, when the first to fourth bypass tubes 382 to 388 include air (bubble), there is a possibility of the air (bubble) flowing into the first to fourth supply tubes 372 to 378 when executing the ink circulating process. Accordingly, there is a possibility of the inflowing air (bubble) adversely influencing the image recording (printing) by flowing into the head unit 30 along with the ink.

Therefore, in order to suppress occurring of the disadvantage, ink filling process is performed such that air (bubble) is not present in the first to fourth bypass tubes 382 to 388 by filling the first to fourth bypass tubes 382 to 388 with ink in advance.

In addition, such an ink filling process (also referred to as initial filling process) is performed by a manufacturer when shipping the image recording apparatus 1. In addition, there is a case where the ink filling process is performed by a person in charge of maintenance, a user, or the like when performing the maintenance of the image recording apparatus 1.

Figure 7:
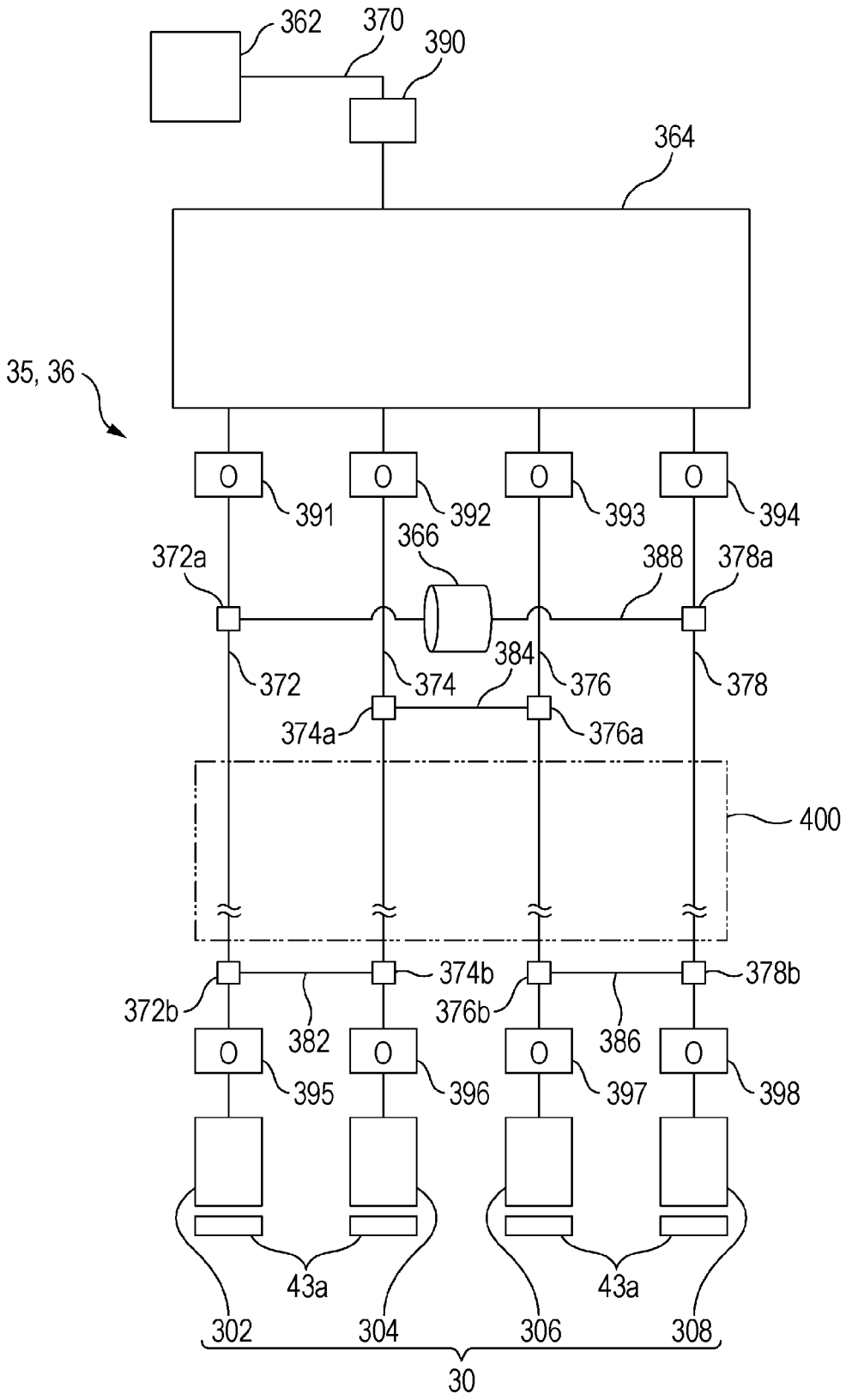
FIG. 7 is a block diagram which illustrates the white ink supply unit before executing an ink filling process.
Figure 8:
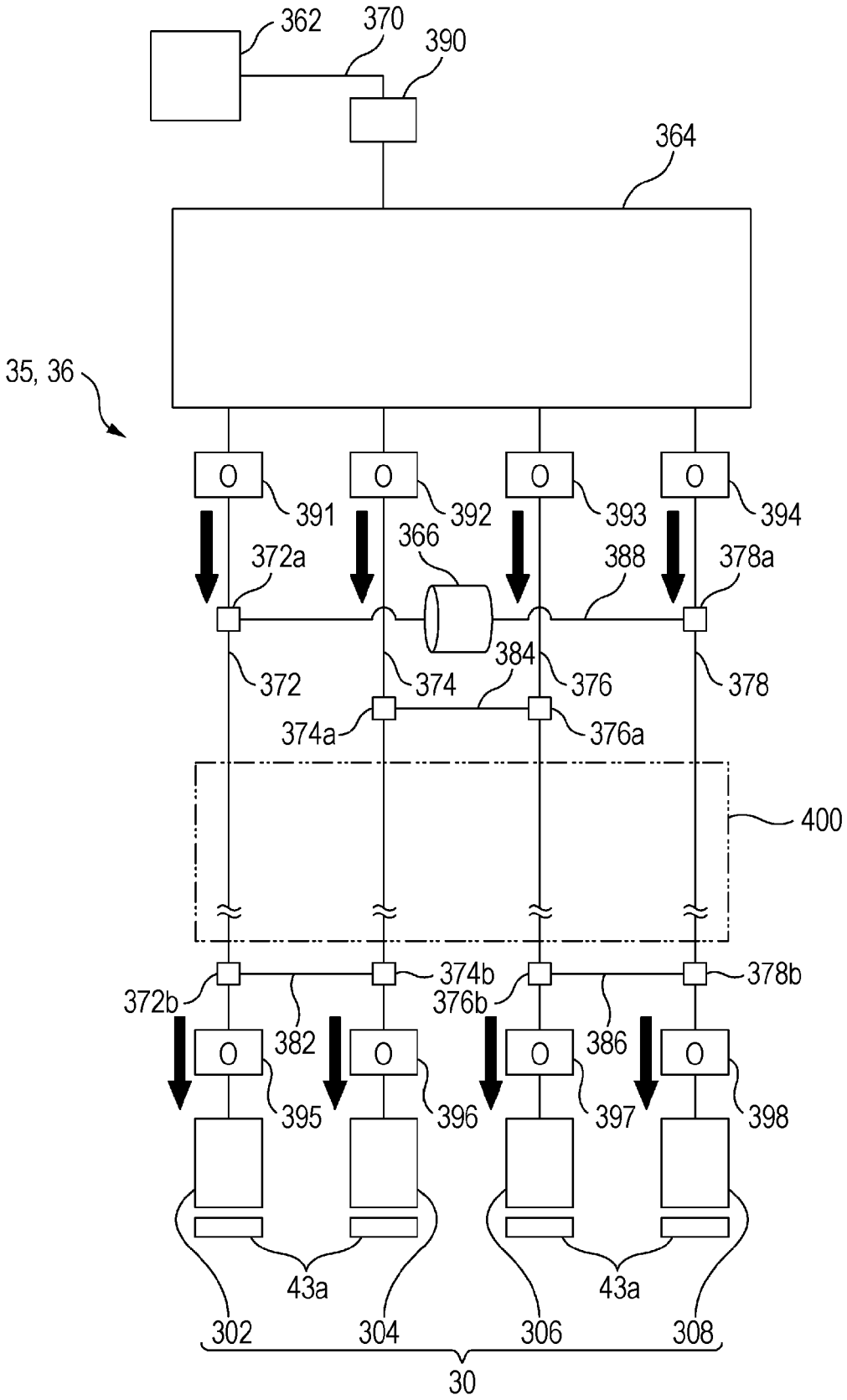
FIG. 8 is a block diagram which illustrates the white ink supply unit when the supply tube filling process is performed.
Figure 9:
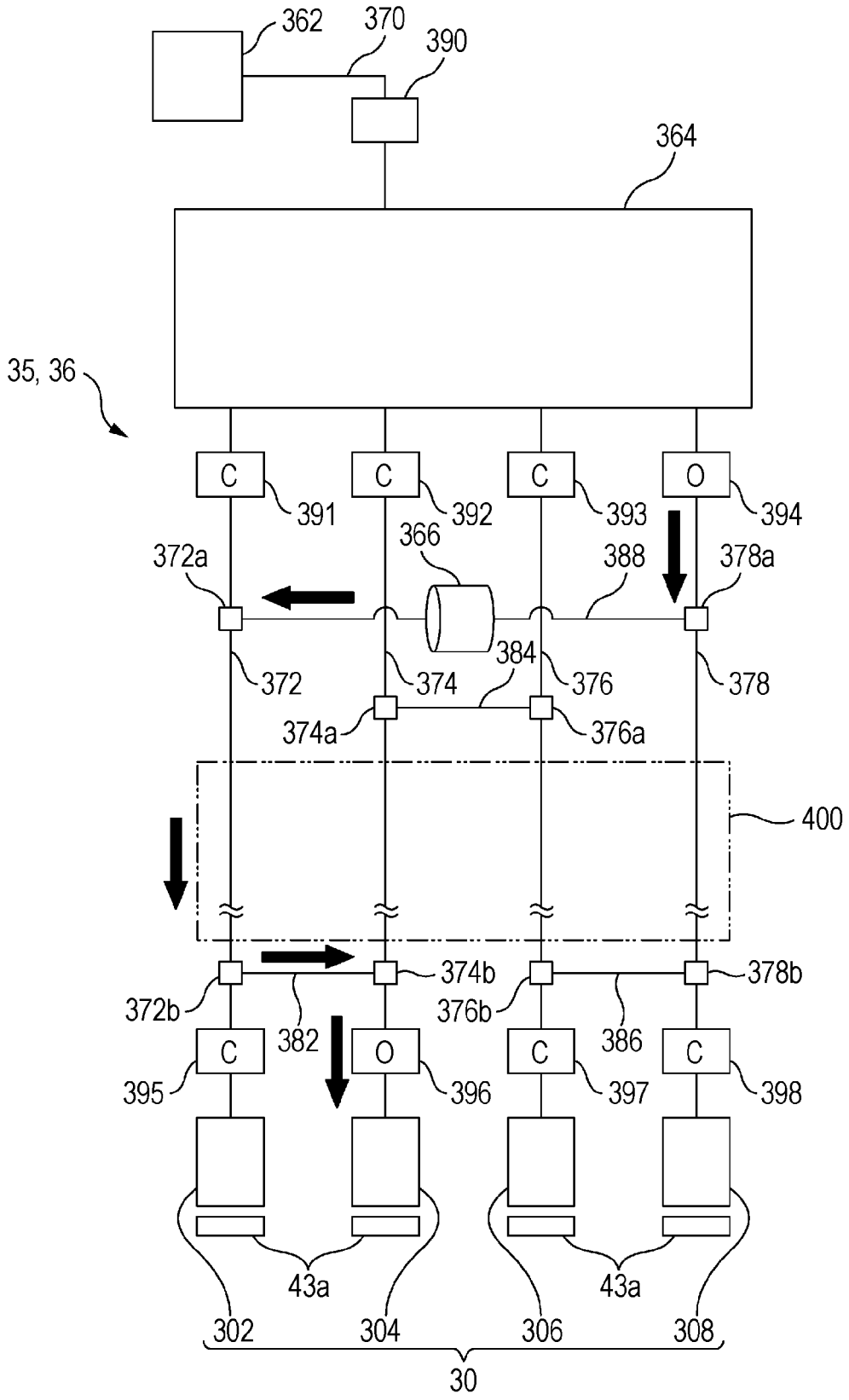
FIG. 9 is a block diagram which illustrates the white ink supply unit when a first step of a bypass tube filling process is performed.
Figure 10:
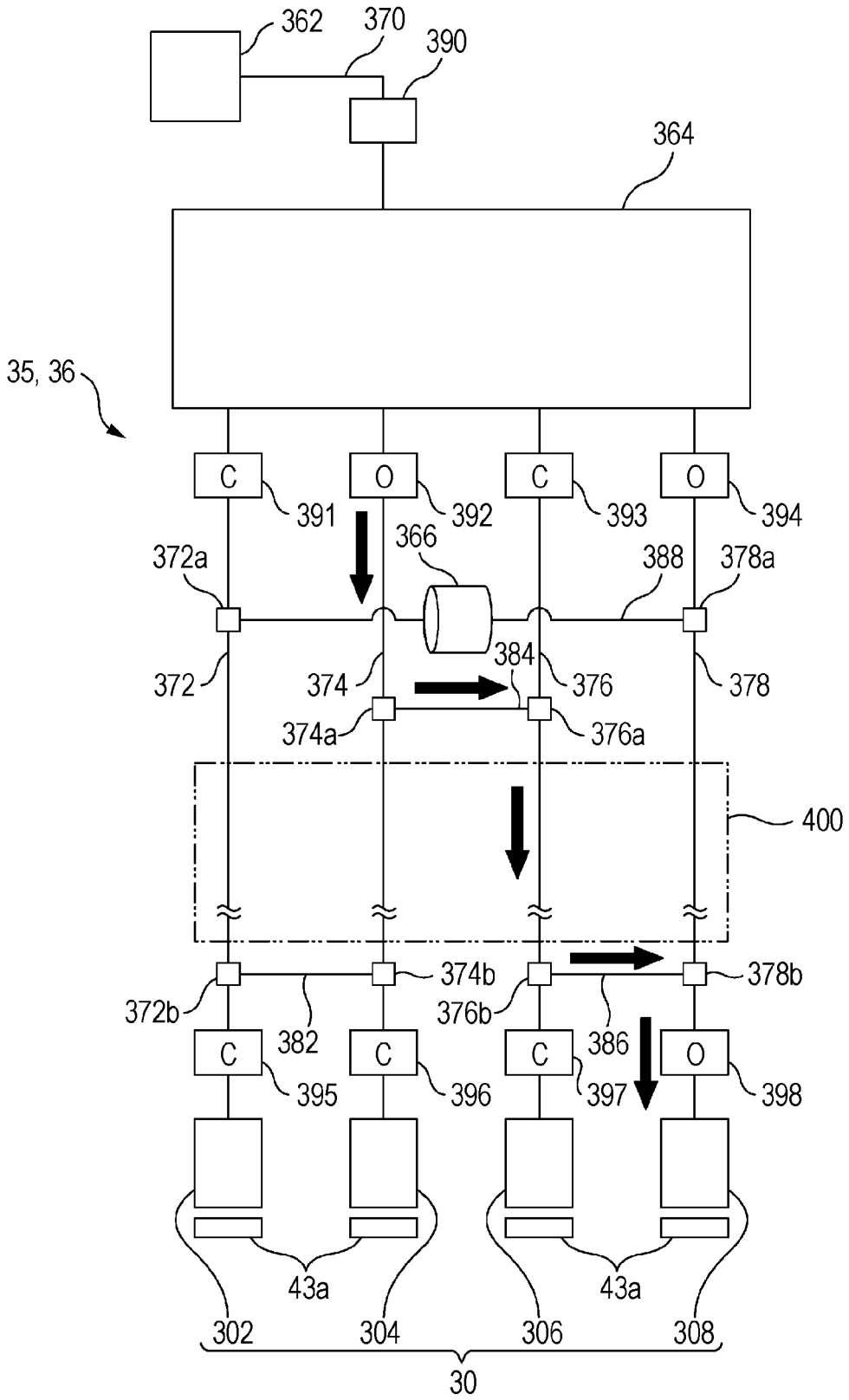
FIG. 10 is a block diagram which illustrates the white ink supply unit when a second step of a bypass tube filling process is performed.

Hereinafter, ink filling process will be described using FIGS. 7 to 10. FIG. 7 is a block diagram which illustrates the white ink supply unit 36 before performing the ink filling process. FIG. 8 is a block diagram which illustrates the white ink supply unit 36 when performing the ink filling process with respect to the supply tube (referred to as supply tube filling process, for convenience). FIGS. 9 and 10 are block diagrams which illustrate the white ink supply unit 36 when performing the ink filling process with respect to the bypass tube (referred to as bypass tube filling process, for convenience). FIG. 9 denotes a first step of a bypass tube filling process, and FIG. 10 denotes a second step of the bypass tube filling process, respectively.

First, it is necessary to pay attention to FIG. 7. FIG. 7 illustrates the white ink supply unit 36 before performing the ink circulating process. At this time, as shown in FIG. 7, the sub-tank side-valves and the head unit-side valves are closed. In addition, though it is not shown in the figure, the head unit 30 (head 31) is located at the HP, and a cap comes into close contact with the base (nozzle surface) of the head 31.

In addition, in the state, first, the supply tube filling process is performed by the controller 60. That is, the controller 60 causes ink to flow into the supply tube, and fills ink into the supply tube. More specifically, by causing ink to flow to the head unit 30 by passing through each of the first to fourth supply tubes 372 to 378 from the sub-tank 364, the first to fourth supply tubes 372 to 378 are filled with ink. In addition, according to the embodiment, in order to execute the process, the controller 60 causes the suction pump 43*a* of the cleaning unit 43 to operate. In this manner, ink flows as shown in the arrow in FIG. 8, and the first to fourth supply tubes 372 to 378 are filled with the ink.

Subsequently, the bypass tube filling process is performed by the controller 60. That is, the controller 60 fills ink into the bypass tube by causing ink to flow to the bypass tube. More specifically, the bypass tube is filled with ink by causing ink to flow to the head unit 30 passing through the bypass tube from the sub-tank 364.

In addition, according to the embodiment, the bypass tube filling process is performed by being divided into two steps.

As shown in FIG. 9, in the first step, the fourth and first bypass tubes 388 and 382 are filled with ink by causing ink to flow to the head unit 30 (more specifically, to second head group 304) by passing through the fourth supply tube 378 (corresponding to first supply flow path), the fourth bypass tube 388 (corresponding to first bypass flow path), the first supply tube 372 (corresponding to second supply flow path), the first bypass tube 382 (corresponding to second bypass flow path), and the second supply tube 374 (corresponding to third supply flow path) from the sub-tank 364.

In addition, according to the embodiment, as shown in FIG. 9, the controller 60 closes the valves other than the fourth sub-tank-side valve 394 and the second head unit-side valve 396 (that is, first sub-tank-side valve 391, second-sub-tank-side valve 392, third sub-tank-side valve 393, first head unit-side valve 395, third head unit-side valve 397, and fourth head unit-side valve 398), in order to execute the process, and causes the suction pump 43*a* corresponding to the second head group 304 to operate. In this manner, the fourth and first bypass tubes 388 and 382 are filled with ink when the ink flows thereto as shown by the arrow in FIG. 9.

In the second step, as shown in FIG. 10, the second bypass tube 384 and the third bypass tube 386 are filled with ink by causing ink to flow to the head unit 30 (more specifically, fourth head group 308) from the sub-tank 364 passing through the second supply tube 374 (corresponding to third supply flow path), the second bypass tube 384 (corresponding to third bypass flow path), the third supply tube 376 (corresponding to fourth supply flow path), the third bypass tube 386 (corresponding to fourth bypass flow path), and the fourth supply tube 378 (corresponding to first supply flow path.

In addition, according to the embodiment, as shown in FIG. 10, the controller 60 closes the valves other than the second sub-tank-side valve 392, and the fourth head unit-side valve 398 (that is, first sub-tank-side valve 391, third sub-tank-side valve 393, fourth sub-tank-side valve 394, first head unit-side valve 395, second head unit-side valve 396, and third head unit-side valve 397), and causes the suction pump 43*a* corresponding to the fourth head group 308 to operate, in order to execute the process. In this manner, the second bypass tube 384 and the third bypass tube 386 are filled with ink when the ink flows thereto as shown in the arrow in FIG. 10.

In this manner, when the first and second steps are completed, the first to fourth bypass tubes 382 to 388 are filled with ink.

Regarding Effectiveness of Image Recording Apparatus 1 According to the Embodiment As described above, the image recording apparatus 1 according to the embodiment includes the sub-tank 364 which stores ink, the head unit 30 which ejects ink to the rolled paper 2, the plurality of supply tubes which supplies ink to the head unit 30 from the sub-tank 364, the plurality of bypass tubes straddling the supply tubes which are different from each other, and the controller 60 which circulates ink in the circulating flow path which is configured only by the supply tube and the bypass tube among the sub-tank 364, the head unit 30, the supply tube and the bypass tube. In this manner, it is possible to make ink in the supply tube flow using a simple configuration.

That is, as described above, ink has stagnated in the supply tube, and the phenomenon (disadvantage) of settling of the components of the ink has occurred. In addition, when the phenomenon occurs, there has been a problem in that an image quality is deteriorated since the ink which lacks the components is ejected to the rolled paper 2.

Figure 11:
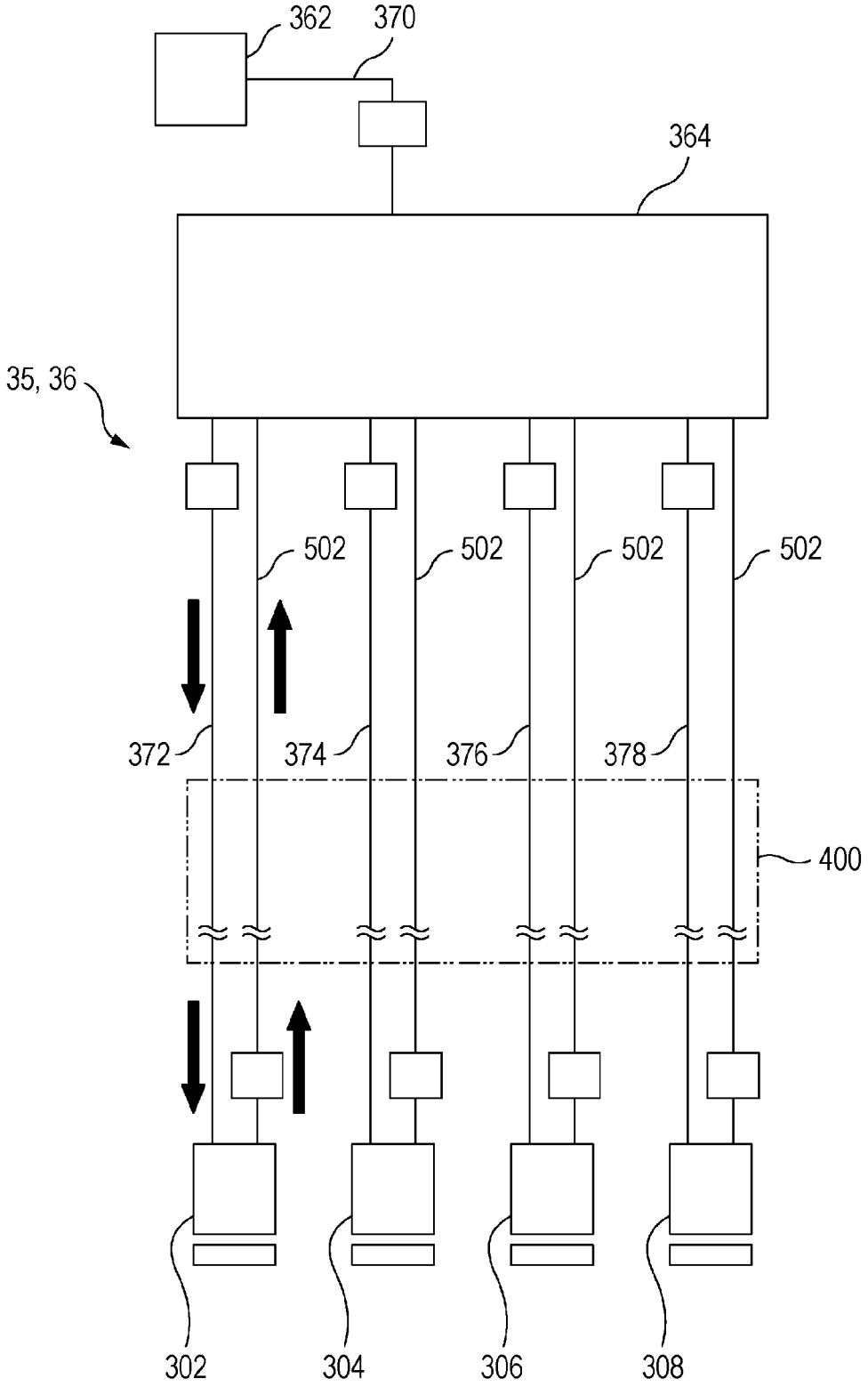
FIG. 11 is a block diagram of the white ink supply unit according to a comparison example.

In order to improve the phenomenon (disadvantage), in the image recording apparatus 1 according to a comparison example, similarly to the embodiment, a method in which ink is caused to flow by circulating the ink in the circulating flow path has been adopted. However, in the image recording apparatus 1 according to the comparison example, as shown in FIG. 11, a return tube 502 for returning ink to the sub-tank 364 from the head unit 30 is provided in order to form the circulating flow path, and ink is circulated in the circulating flow path (refer to arrow in FIG. 11) which is configured by the sub-tank 364, the supply tube (for example, first supply tube 372), the head unit 30, and the return tube 502.

In addition, in the case, there has been the following disadvantage. That is, it is necessary for the return tube 502 to be connected to the sub-tank 364 and the head unit 30, and this connection is not a simple work. In addition, when there is the plurality of supply tubes (for example, four), it is essential to connect each return tube to the sub-tank 364 and the head unit 30, by preparing for the return tubes corresponding to each of the supply tubes (for example, four) (refer to FIG. 11). In this way, it is difficult to say that the white ink supply unit 36 according to the comparison example has a simple configuration.

In contrast to this, the inventor or the like of this application conducted thorough investigations in order to make the configuration simple, and as a result, they paid attention to the fact that there is a plurality of supply tubes, and were led to the idea of forming the circulating flow path by connecting the supply tubes using the bypass tubes. That is, ink is circulated in the circulating flow path which is configured only by the supply tube and the bypass tube among the sub-tank 364, the head unit 30, the supply tube and the bypass tube. In this manner, it is possible to form the circulating flow path without using the return tube 502 which is necessarily connected to the sub-tank 364 and the head unit 30, and to make the configuration simple. That is, according to the embodiment, it is possible to make ink in the supply tube flow using a simple configuration.

In addition, according to the embodiment, since the bypass tube configuring the circulating flow path straddles supply tubes different from each other, different from the comparison example, the circulating flow path is configured by the plurality of supply tubes (on the other hand, in comparison example, circulating flow path is configured by only one supply tube (and return tube)). In addition, the embodiment has the following superiority which is not present in the comparison example due to this difference.

That is, when ink in the head unit 30 (head 31) is consumed by performing the image recording (printing), an ink cartridge 362 is replaced in order to replenish ink, however, at this time, there may be a case where a lot of ink is changed to a new lot from the old lot. In addition, in such a case, a situation may occur in which a certain supply tube is filled with ink of the new lot, however, other supply tubes are filled with ink of the old lot.

Such a situation occurs when the amount of ink consumption is different depending on the head 31 (or a head group). As an example, as described above, there may be a case where the first to fourth head groups 302 to 308 are provided as the head group, however, ink in the fourth head group 308 is not consumed at all even though the image recording (printing) is performed. As an example of the case, there may be a case where an image corresponding to the fourth head group 308

(image to be formed by ejecting ink from fourth head group 308) itself is not present. In addition, since a rolled paper 2 with the narrow width is used, there is also a case where the rolled paper 2 is not present at the position corresponding to the fourth head group 308 (position to be formed with image by ejecting ink from fourth head group 308). In addition, in such a case, ink is consumed from the first to third head groups 302 to 306, however, the ink is not consumed from the fourth head group 308. Accordingly, a situation (situation in which ink of new lot does not easily flow in) may occur in which ink of new lot flows into the first to third supply tubes 372 to 376, however, ink of the old lot remains in the fourth supply tube 378 for a long time.

In addition, in the situation, since the circulating flow path is configured by only one supply tube in the comparison example, the ink in the old lot and the ink in the new lot are not appropriately mixed even when the ink is circulated in the circulating flow path. In contrast to this, according to the embodiment, since the circulating flow path is configured by the plurality of supply tubes, the ink in the old lot and the ink in the new lot are appropriately mixed when the ink is circulated in the circulating flow path. Accordingly, the above embodiment is more preferable since it is possible to suppress deterioration of the image quality due to the presence of a portion in the image which is formed using the respective inks of the old lot and the new lot which are slightly different in hue from each other (portion of ink of old lot and portion of ink of new lot).

In addition, in the above description, the fourth bypass tube 388 (corresponding to first bypass flow path) and the second bypass tube 384 (corresponding to third bypass flow path) are provided at between the cableveyor 400 and the sub-tank 364 which is the outside of the cableveyor 400, and the first bypass tube 382 (corresponding to second bypass flow path) and the third bypass tube 386 (corresponding to fourth bypass flow path) are provided at between the cableveyor 400 and the head unit 30 which is the outside of the cableveyor 400. For this reason, by arranging the first bypass tube 382 at the opposite side to the second bypass tube 384 by being separated from the cableveyor 400, the distance between both becomes long. In addition, similarly, the distance between the second bypass tube 384 and the third bypass tube 386, the distance between the third bypass tube 386 and the fourth bypass tube 388, and the distance between the fourth bypass tube 388 and the first bypass tube 382 become long, respectively. Accordingly, since the length of the first supply tube 372 to the fourth supply tube 378 configuring the circulating flow path becomes long, it is possible to make ink in the supply tube flow over a wide range (in other words, it is possible to make portions which do not belong to circulating flow path among supply tubes prominently small).

Regarding Variation of Image Recording Apparatus 1

In the above description, an example has been illustrated (first embodiment) in FIG. 4 or the like, as the image recording apparatus 1 which includes the sub-tank 364 which stores ink, the head unit 30 which ejects ink onto the rolled paper 2, the plurality of supply tubes which supply ink to the head unit 30 from the sub-tank 364, the plurality of bypass tubes which straddles the supply tubes which are different from each other, and the controller 60 which circulates ink in the circulating flow path which is configured only by the supply tube and the bypass tube among the sub-tank 364, the head unit 30, the supply tube and the bypass tube, however, it is not limited to this.

Hereinafter, another embodiment (second to fourth embodiments) of the image recording apparatus 1 will be described.

Figure 12:
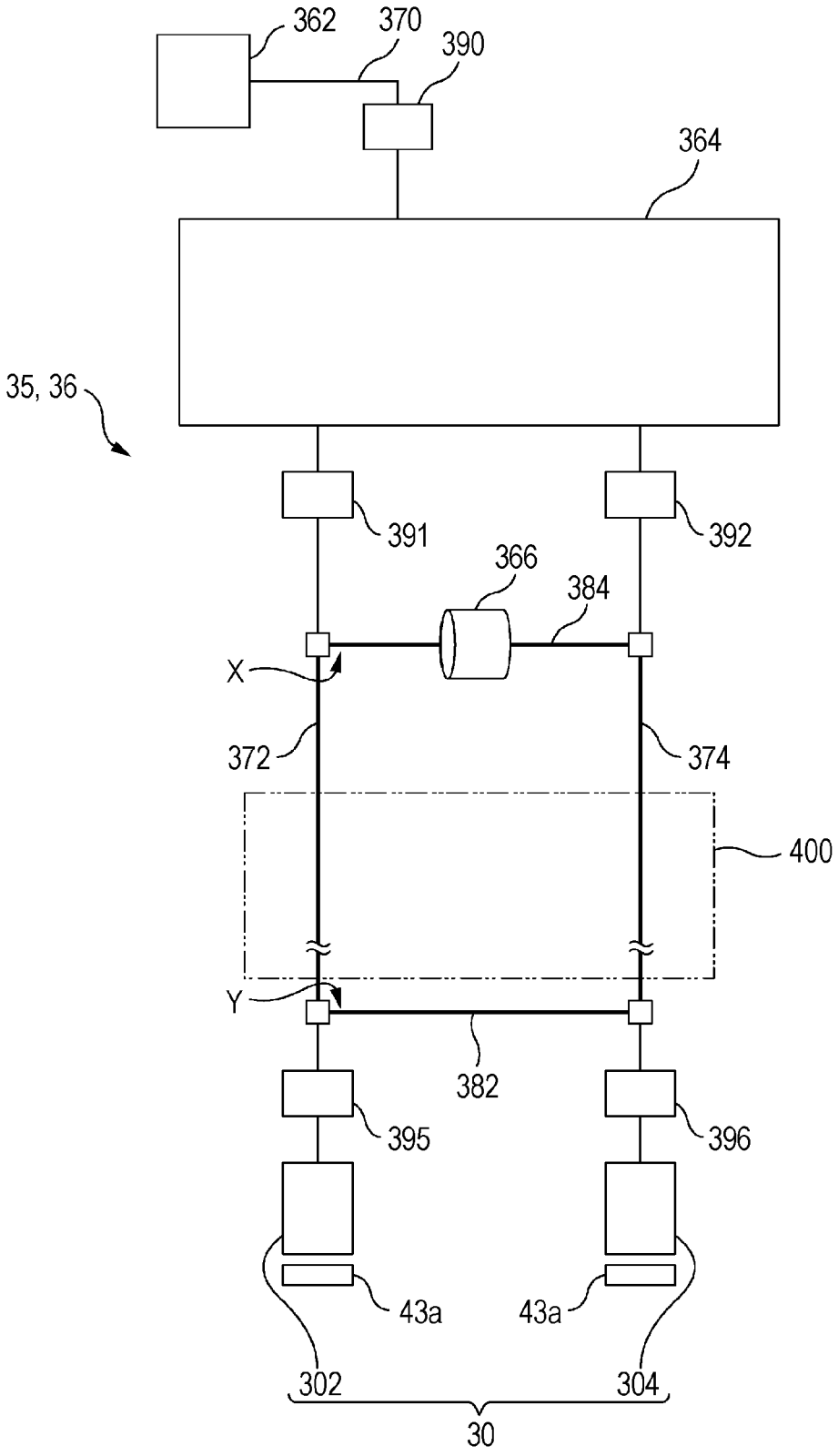
FIG. 12 is a block diagram of the white ink supply unit according to a second embodiment.

In the above description, the image recording apparatus 1 which is provided with four supply tubes has been exemplified, however, it is not limited to this. As shown in FIG. 12, it may be an image recording apparatus 1 which is provided only with two supply tubes. FIG. 12 is a diagram corresponding to FIG. 4, and is a block diagram of the white ink supply unit 36 according to a second embodiment.

That is, according to the embodiment, as shown in FIG. 12, a sub-tank 364 is connected to a head unit 30 which is provided with fifteen heads 31 through a first supply tube 372 and a second supply tube 374. In addition, the fifteen heads 31 are provided in two head groups, that is, a first head group 302 to which eight heads 31 belong, and a second head group 304 to which seven heads 31 belong, and each of two supply tubes is connected to each of the two head groups, respectively.

In addition, a bypass tube straddles supply tubes which are different from each other. That is, according to the second embodiment, as shown in FIG. 12, two bypass tubes (first bypass tube 382 and second bypass tube 384) are provide, and both the first bypass tube 382 and second bypass tube 384 straddle the first supply tube 372 and the second supply tube 374. In addition, ink is circulated in a circulating flow path which is configured by the first supply tube 372, the first bypass tube 382, the second supply tube 374, and the second bypass tube 384.

In addition, even in such a second embodiment, similarly to the first embodiment, it is possible to make ink in the supply tube to flow using a simple configuration. In addition, it is possible to suppress deterioration of image quality due to the presence of a portion which is formed using each ink of an old lot and a new lot in an image, respectively.

However, when comparing the first embodiment to the second embodiment, the first embodiment has superiority in the following facts.

That is, according to the second embodiment, since only two supply tubes are provided, it is necessary to straddle the plurality of bypass tubes with respect to the two supply tubes (set of two supply tubes) in order to configure a circulating flow path. In addition, in the circulating flow path having the configuration, the following disadvantage may occur in the above-described filling process (more specifically, bypass tube filling process).

Figure 13:
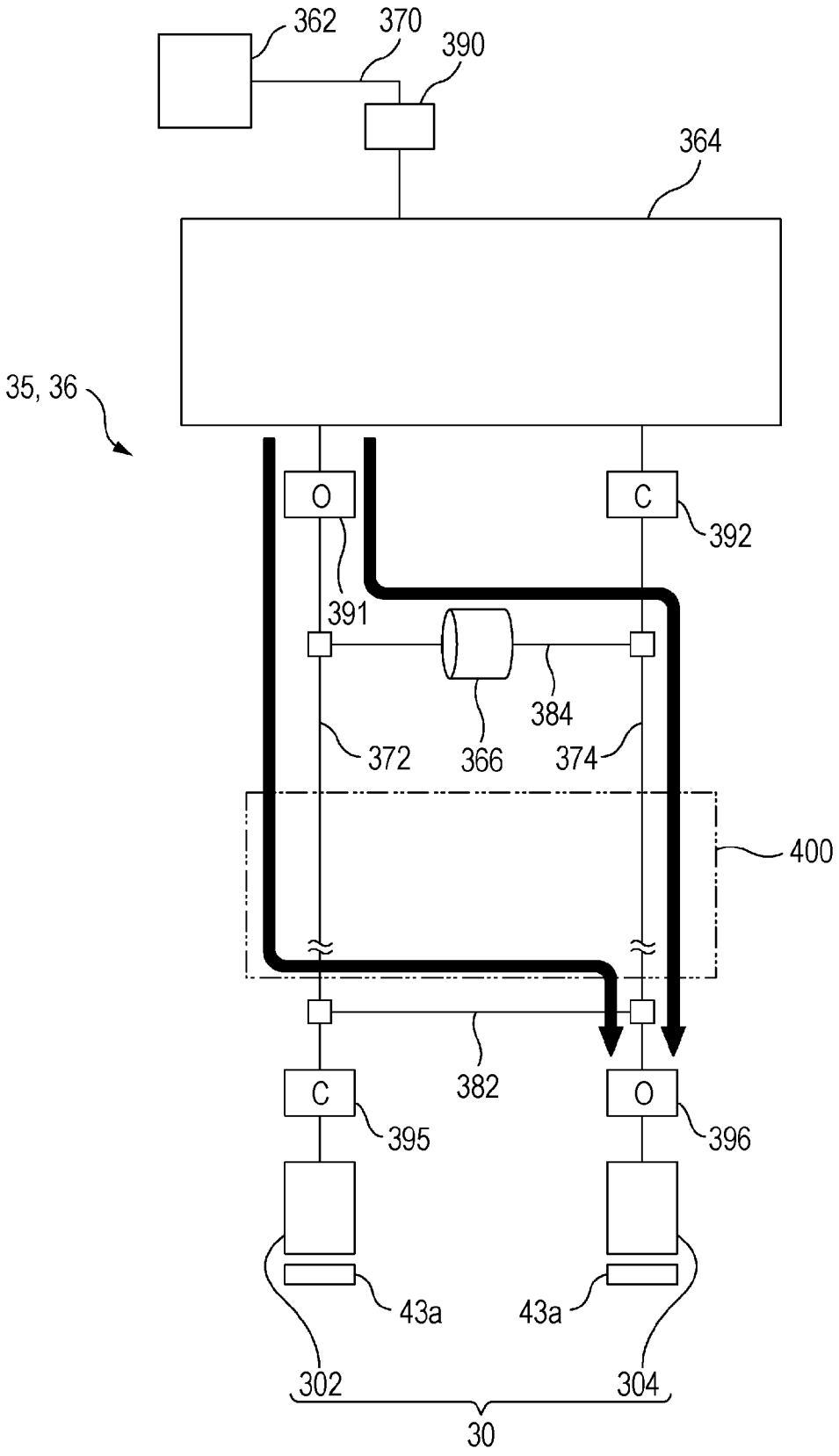
FIG. 13 is an explanatory block diagram which describes disadvantage when the bypass tube filling process is performed in the second embodiment.

Descriptions will be made using FIG. 13. FIG. 13 is an explanatory block diagram which describes disadvantage when performing the bypass tube filling process in the second embodiment.

FIG. 13 denotes a situation when a suction pump 43*a* corresponding to a second head group 304 is operated by closing a second sub-tank-side valve 392 and a first head-unit side valve 395 in order to fill ink in the bypass tube.

However, in this case, two equal routes as routes to which ink flows from the sub-tank 364 to the second head group 304 are generated (refer to arrow in FIG. 13) due to the fact that the plurality of bypass tubes (that is, the first and second bypass tubes 382 and 384) straddle with respect to the two supply tubes (set of supply tubes). For this reason, it is difficult to make ink stably flow through any of routes (that is, it is difficult to make ink flow through any of routes constantly, since ink flows through a first route at a certain time, and flows through a second route in another time, or the like). Accordingly, it is difficult to make ink stably flow to the first bypass tubes 382, or the second bypass tube 384, and to appropriately fill the ink into the first bypass tubes 382, and the second bypass tube 384.

In addition, in order to solve this problem, it is necessary to introduce additional valves, and as a result, there is a problem of an increase in cost, or the like (for example, valves are provided at each of first bypass tube 382, and second bypass tube (position denoted by the marks X and Y in FIG. 12), and when it is desired to make ink flow to first bypass tube 382 side, valve at position X is closed, and when it is desired to make ink flow to second bypass tube 384 side, valve at position Y is closed).

In contrast to this, according to the first embodiment, since there are three or more supply tubes, it is not necessary to straddle the plurality of bypass tubes with respect to the two supply tubes (set of supply tubes) in order to configure the circulating flow path. That is, in the circulating flow path according to the first embodiment, it is configured such that the plurality of bypass tubes are not straddled between the two supply tubes with respect to any of the two sets of supply tubes among the supply tubes of three or more.

For this reason, the disadvantage which occurs when performing the above-described bypass tube filling process does not occur, and on this point, the first embodiment has superiority compared to the second embodiment.

Figure 14:
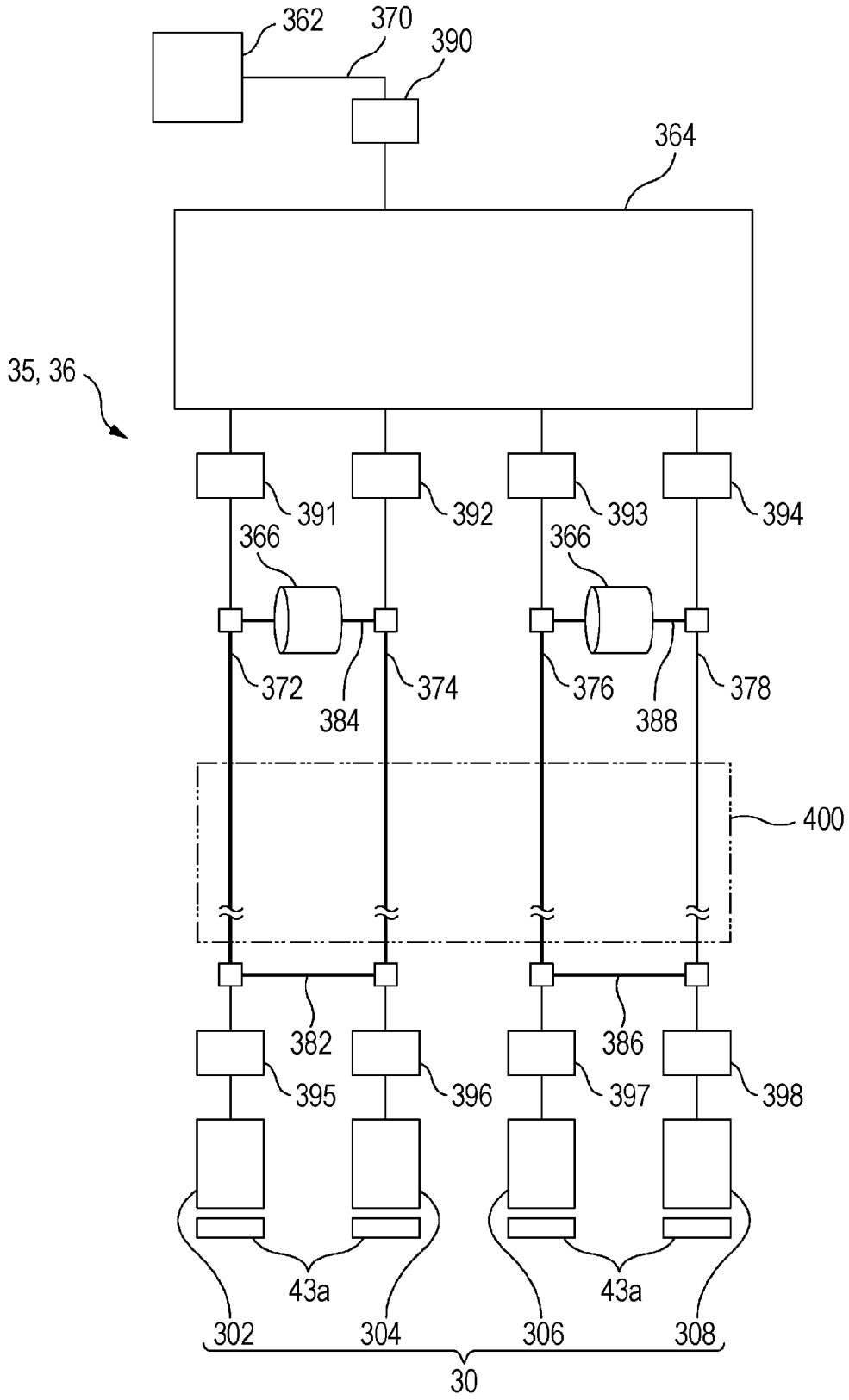
FIG. 14 is a block diagram of the white ink supply unit according to a third embodiment.

In addition, the embodiment in which the plurality of bypass tubes straddles with respect to the two supply tubes (set of supply tubes) in order to configure the circulating flow path is not limited to the example shown in FIG. 12 in which only two supply tubes are provided. For example, as shown in FIG. 14, there is an example in which the plurality of bypass tubes straddles with respect to the two supply tubes (set of supply tubes) even in the image recording apparatus 1 in which four supply tubes are provided (FIG. 14 is a diagram corresponding to FIG. 4, and is a block diagram of white ink supply unit 36 according to a third embodiment). In addition, even in such a third embodiment, similarly to the first embodiment, it is possible to make ink in the supply tube to flow using a simple configuration. In addition, it is possible to suppress deterioration of the image quality which is caused by the presence of a portion which is formed using each ink of the old lot and the new lot in an image.

Figure 15:
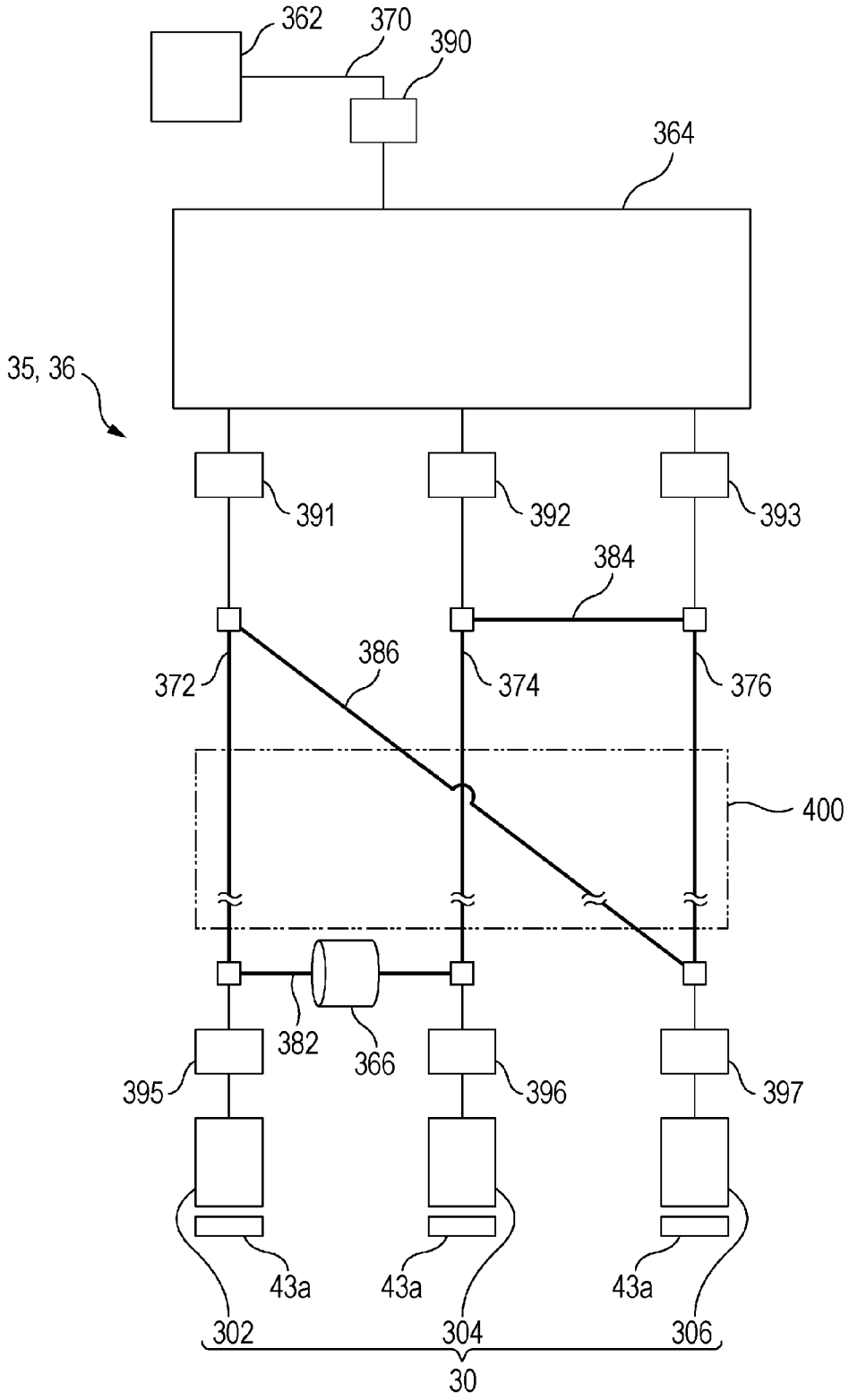
FIG. 15 is a block diagram of the white ink supply unit according to a fourth embodiment.

In addition, as shown in FIG. 15, different from the first and second embodiment, image recording apparatus 1 may be provided with only three supply tubes. FIG. 15 is a diagram corresponding to FIG. 4, and is a block diagram of a white ink supply unit 36 according to a fourth embodiment.

That is, in the fourth embodiment, as shown in FIG. 15, a sub-tank 364 is connected to a head unit 30 including fifteen heads 31 through a first supply tube 372, a second supply tube 374, and a third supply tube 376. In addition, the fifteen heads 31 includes three head group, that is, a first head group 302 to a third head group 306 to which five heads 31 belong, respectively, and each of three supply tubes is connected to the three head groups, respectively.

In addition, the bypass tube straddles the supply tubes which are different from each other. That is, according to the fourth embodiment, as shown in FIG. 15, three bypass tubes (first to third bypass tubes 382 to 386) are provided, the first bypass tube 382 straddles the first and second supply tubes 372 and 374, the second bypass tube 384 straddles the second and third supply tubes 374 and 376, and the third bypass tube 386 straddles the third and first supply tubes 376 and 372. In addition, ink is circulated in a circulating flow path which is configured by the first supply tube 372, the first bypass tube 382, the second supply tube 374, the second bypass tube 384, the third supply tube 376, and the third bypass tube 386.

In addition, even in such a fourth embodiment, similarly to the first embodiment, it is possible to make ink in the supply tube flow using a simple configuration. In addition, it is possible to suppress deterioration of the image quality due to the presence of a portion of an image which is formed using each ink of an old lot and of a new lot.

However, when comparing the first embodiment to the fourth embodiment, the first embodiment has superiority in the following.

That is, according to the fourth embodiment, since there are only three supply tubes, when it is desired to make the length of the first to third supply tubes 372 to 376 which configure the circulating flow path (in other words, it is desired to reduce portions which do not belong to circulating flow path among supply tubes), as shown in FIG. 15, the length of one bypass tube among three bypass tubes (third bypass tube 386 according to fourth embodiment) (like supply tube) becomes long.

In contrast to this, differently from the fourth embodiment, according to the first embodiment, as three or more supply tubes, four supply tubes, that is, the first supply tube 372 (corresponding to second supply flow path), the second supply tube 374 (corresponding to third supply flow path), the third supply tube 376 (corresponding to fourth supply flow path), and the fourth supply tube 378 (corresponding to first supply flow path) are included, and the first bypass tube 382 (corresponding to second bypass flow path) which straddles the first supply tube 372 and second supply tube 374, the second bypass tube 384 (corresponding to third bypass flow path) which straddles the second supply tube 374 and third supply tube 376, the third bypass tube 386 (corresponding to fourth bypass flow path) which straddles the third supply tube 376 and fourth supply tube 378, and the fourth bypass tube 388 (corresponding to first bypass flow path) which straddles the fourth supply tube 378 and first supply tube 372 are included, and the circulating flow path is configured by the first supply tube 372, the first bypass tube 382, the second supply tube 374, the second bypass tube 384, the third supply tube 376, the third bypass tube 386, the fourth supply tube 378, and the fourth bypass tube 388.

For this reason, as shown in FIG. 4, it is possible to make the length of the bypass tube short, and on this point, the first embodiment has superiority compared to the fourth embodiment.

In addition, according to the first embodiment, when ink in the supply flow path is circulated using the configuration of the circulating flow path, ink of the old lot and ink of the new lot are appropriately mixed together in all of the supply tubes (of four) (on the other hand, for example, according to the third embodiment, even when the ink is desired to be mixed in the first and second supply tubes (or, in the third and fourth tubes), the ink is not mixed together in all of the supply tubes). For this reason, it is possible to further suppress deterioration of the image quality.

In addition, in the above description, a case where there are four or fewer supply tubes has been denoted, however, naturally, it is also possible to apply the present invention to a case of five or more supply tubes.

Other Embodiments

A liquid ejecting apparatus has been mainly described in the above-described embodiment, however, a disclosure of a method of liquid circulating or the like is also included therein. In addition, the embodiment is for easily understanding the invention, and is not for limiting the invention. The invention may be changed and modified without departing from the scope of the invention, and it goes without saying that the equivalents thereof are included in the invention as a matter of course. In particular, the embodiments described below are included in the invention as well.

In the above-described embodiments, a liquid ejecting apparatus has been exemplified as the ink jet printer, however, it may be a liquid ejecting apparatus in which another liquid other than the ink is ejected. It may be applied to a variety of liquid ejecting apparatus including a liquid ejecting head or the like which ejects minute amounts of liquid droplets. In addition, the liquid droplets mean a state of liquid which is ejected from the liquid ejecting apparatus, and includes a granular shape, a tear shape, or a thread shape leaving a trail. In addition, the liquid here may be a material which can be ejected by the liquid ejecting apparatus. For example, the material may include a material in a state of liquid phase, materials which flow such as a liquid body having high or low viscosity, sol, gel water, and inorganic solvent, organic solvent, liquid, liquid resin, liquid metal (metallic melt) other than that, or materials in which particles of a functional material which is formed of a solid body such as a pigment or metal particles are melted, diffused, or mixed in a solvent, not only as liquid as a state of the material. In addition, as a representative example of the liquid, the ink, liquid crystal, or the like can be exemplified as described in the above embodiments. Here, the ink includes general water-based ink and oil-based ink, and a variety of liquid compositions such as gel ink, hot-melt ink, or the like. As specific examples of the liquid ejecting apparatus, they may be a liquid ejecting apparatus which ejects liquid including a material such as an electrode material, or a color material which is used when manufacturing, for example, a liquid crystal display, an EL (electroluminescence) display, a plane emission display, a color filter, or the like, in a form of dispersion, or dissolution, a liquid ejecting apparatus which ejects a biological organic substance which is used when manufacturing a biochip, a liquid ejecting apparatus which ejects liquid as a sample which is used as precision pipette, a textile printing device, a microdispenser, or the like. Further, the liquid ejecting apparatus may be a liquid ejecting apparatus which ejects a lubricant to a precision machine such as a clock, a camera, or the like, using a pinpoint, a liquid ejecting apparatus which ejects transparent resin liquid such as UV curable resin for forming a micro bulls-eye (optical lens) which is used in an optical communication element, or the like, onto a substrate, and a liquid ejecting apparatus which ejects an etching liquid such as an acid or alkali for etching a substrate or the like. In addition, it is possible to apply the invention to any one of these a liquid ejecting apparatuses.

In addition, in the above-described embodiment, the rolled paper 2 has been exemplified as a medium, however, it is not limited to this, and for example, the medium may be a cut-sheet, a film, or cloth.

In addition, according to the above-described embodiment, the sub-tank 364 has been exemplified as a storage unit, however, it is not limited to this. For example, it is also possible to connect the ink cartridge 362 to the head unit 30 through the supply tube without using the sub-tank 364 (in this case, ink cartridge 362 corresponds to storage unit).

In addition, according to the above-described embodiment, the head unit 30 includes the plurality of heads (fifteen), however, it is not limited to this. For example, the head unit 30 may be configured by one head 31.

In addition, according to the above-described embodiment, the ink circulating process is automatically performed when the power supply is turned on, however, it is not limited to this. For example, the ink circulating process may be manually performed (according to user's request).

In addition, according to the above-described embodiment, as three or more supply flow paths, the first supply flow path, the second supply flow path, the third supply flow path, and the fourth supply flow path are included, the first bypass flow path which straddles the first supply flow path and the second supply flow path, the second bypass flow path which straddles the second supply flow path and the third supply flow path, the third bypass flow path which straddles the third supply flow path and the fourth supply flow path, and the fourth bypass flow path which straddles the fourth supply flow path and the first supply flow path are included, and the circulating flow path is configured by the first supply flow path, the first bypass flow path, the second supply flow path, the second bypass flow path, the third supply flow path, the third bypass flow path, the fourth supply flow path, and the fourth bypass flow path. In addition, the first bypass flow path and the third bypass flow path are provided between the cableveyor 400 and the sub-tank 364 which is the outside of the cableveyor 400, and the second bypass flow path and the fourth bypass flow path are provided between the cableveyor 400 and the head unit 30 which is the outside of the cableveyor 400. In addition, when filling ink in the bypass flow path, the first bypass flow path and the second bypass flow path are filled with ink by causing ink to flow to the head unit 30 passing through the first supply flow path, the first bypass flow path, the second supply flow path, the second bypass flow path, and the third supply flow path, from the sub-tank 364, and then to the head unit 30 passing through the third supply flow path, the third bypass flow path, the fourth supply flow path, the fourth bypass flow path, and the first supply flow path, from the sub-tank 364, thereby filling ink into the third and fourth bypass flow paths.

In addition, it is set such that the first supply flow path corresponds to the fourth supply tube 378 which is connected to the fourth head group 308 (thirteenth to fifteenth heads), the second supply flow path corresponds to the first supply tube 372 which is connected to the first head group 302 (first to fourth heads), the third supply flow path corresponds to the second supply tube 374 which is connected to the second head group 304 (fifth to eighth heads), and the fourth supply flow path corresponds to the third supply tube 376 which is connected to the third head group 306 (ninth to twelfth heads), respectively (in addition, according to the correlation, first bypass flow path is correlated with fourth bypass tube 388, second bypass flow path is correlated with first bypass tube 382, third bypass flow path is correlated with second bypass tube 384, and fourth bypass flow path is correlated with third bypass tube 386, respectively). However, it is not limited to such correlation, and the correlation of the first to fourth supply tubes 372 to 378 with respect to the first to fourth supply flow path may be arbitrarily set.

Figure 16:
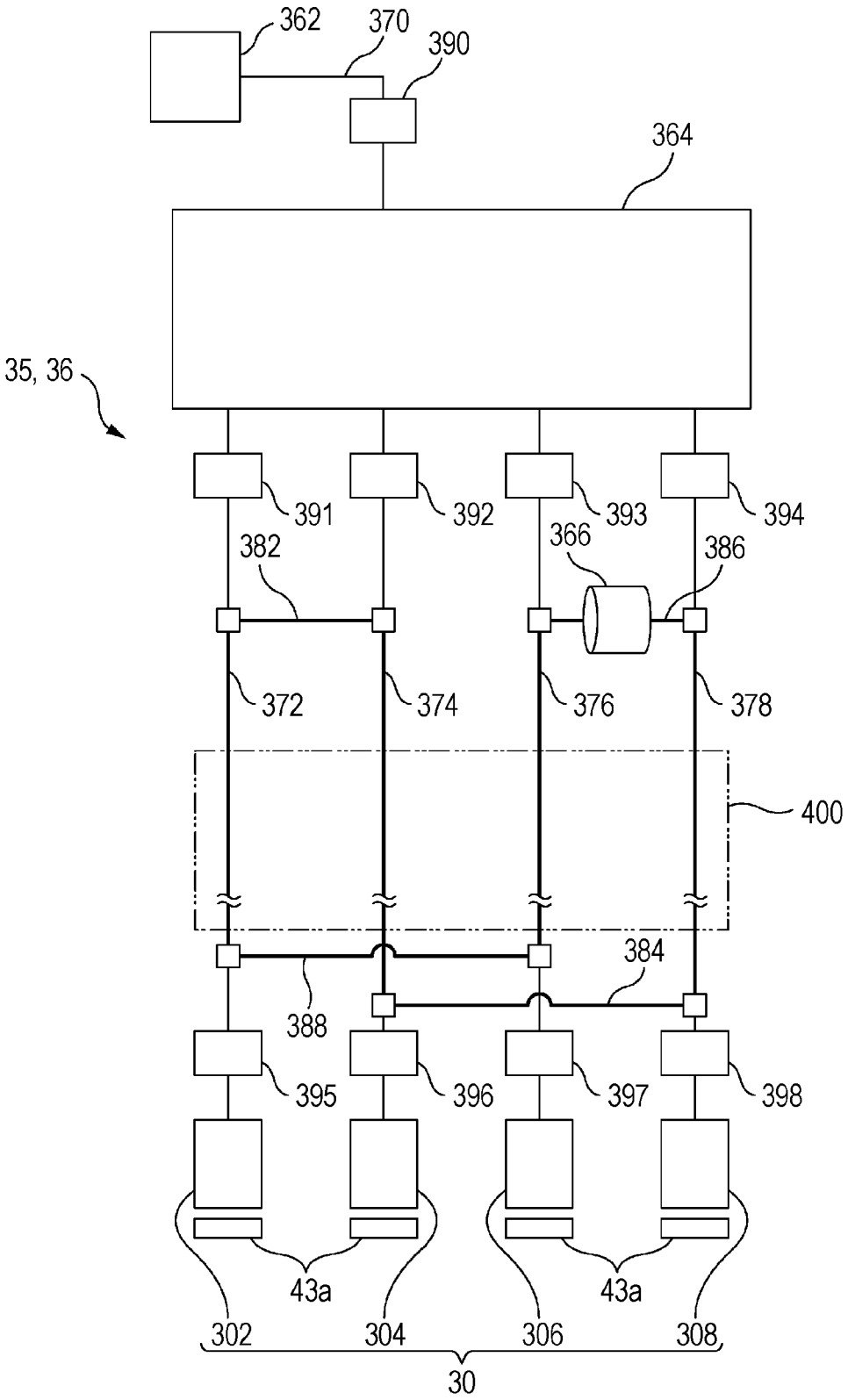
FIG. 16 is a block diagram of the white ink supply unit according to a modification example.
Figure 17:
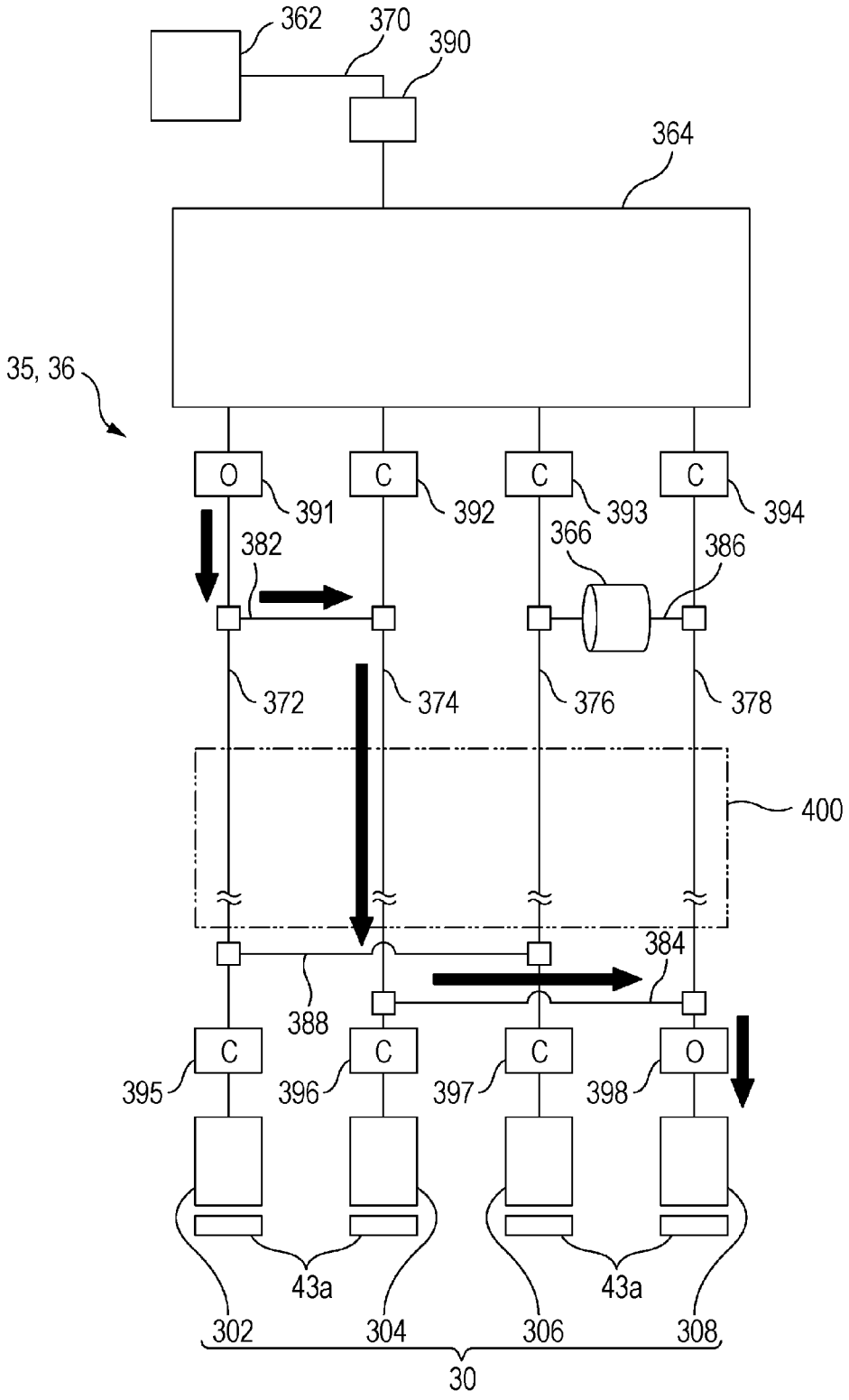
FIG. 17 is a block diagram which illustrates the white ink supply unit when a first step of the bypass tube filling process is performed in the modification example.
Figure 18:
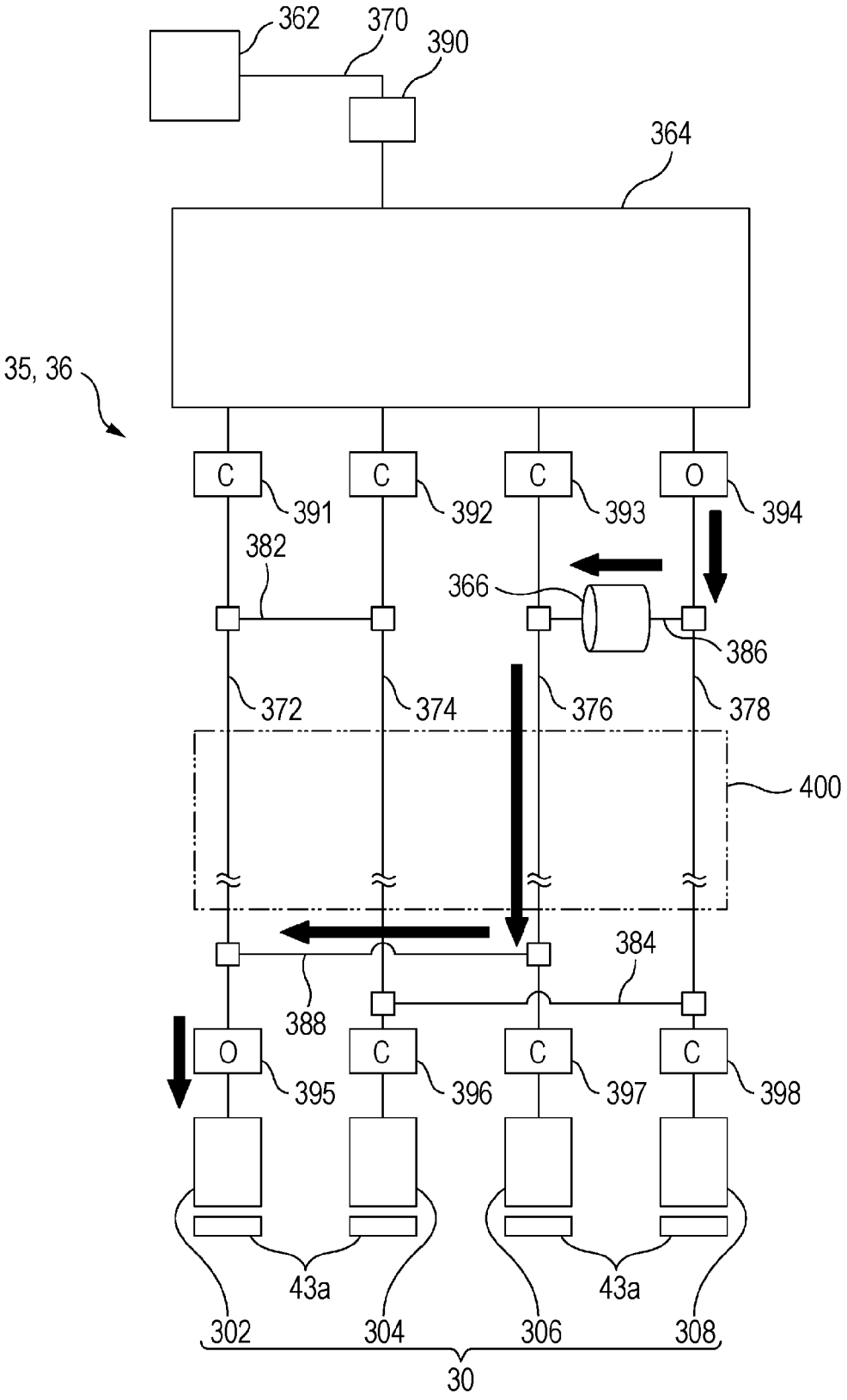
FIG. 18 is a block diagram which illustrates the white ink supply unit when a second step of the bypass tube filling process is performed in the modification example.

As an example (referred to as modification example, for convenience), each corresponding case where the first supply flow path corresponds to the first supply tube 372, the second supply flow path corresponds to the second supply tube 374, the third supply flow path corresponds to the fourth supply tube 378, and the fourth supply flow path corresponds to the third supply tube 376 (at this time, bypass tubes corresponding to each of first bypass flow path, second bypass flow path, third bypass flow path, and fourth bypass flow path are referred to as first bypass tube 382, second bypass tube 384, third bypass tube 386, and fourth bypass tube 388) are denoted by drawings corresponding to FIGS. 4, 9, and 10 (FIGS. 16, 17, and 18).

This application claims the benefit of Japanese Patent Application No. 2011-204918 filed on Sep. 20, 2011, which is hereby incorporated by reference herein in its entirety.

What is claimed is:

1. A liquid ejecting apparatus comprising:

a storage unit which stores liquid;

a head unit which ejects the liquid onto a medium;

three or more supply flow paths which supply the liquid to the head unit from the storage unit;

a plurality of bypass flow paths which straddles the supply flow paths which are different from each other; and a controller which circulates the liquid in a closed-loop circulating flow path which is comprised of the supply flow path and the bypass flow path only, such that when circulating in the closed-loop circulating flow path, the liquid substantially only circulates in the supply path and the bypass path, wherein the closed-loop circulating flow path is configured such that the plurality of bypass flow paths does not straddle between the two supply flow paths with respect to any set of two supply flow paths among three or more supply flow paths.

2. The liquid ejecting apparatus according to claim 1, further comprising:

a first supply flow path, a second supply flow path, a third supply flow path, and a fourth supply flow path as the three or more supply flow path;

a first bypass flow path which straddles the first supply flow path and the second supply flow path;

a second bypass flow path which straddles the second supply flow path and the third supply flow path;

a third bypass flow path which straddles the third supply flow path and the fourth supply flow path; and a fourth bypass flow path which straddles the fourth supply flow path and the first supply flow path, wherein the closed-loop circulating flow path is configured by the first supply flow path, the first bypass flow path, the second supply flow path, the second bypass flow path, the third supply flow path, the third bypass flow path, and the fourth supply flow path and the fourth bypass flow path.

3. The liquid ejecting apparatus according to claim 2, further comprising:

a cableveyor which causes the first to fourth supply flow paths to be trained, wherein the first bypass flow path and the third bypass flow path are provided between the cableveyor and the storage unit which is the outside of the cableveyor, and the second bypass flow path and the fourth bypass flow path are provided between the cableveyor and the head unit which is the outside of the cableveyor.

4. A method of circulating liquid comprising:

preparing for a liquid ejecting apparatus including a storage unit which stores liquid, a head unit which ejects the liquid onto a medium, three or more supply flow paths which supplies the liquid to the head unit from the storage unit, and a plurality of bypass flow paths which straddles the supply flow paths which are different from each other; and circulating the liquid in a closed-loop circulating flow path which is configured by the supply flow path and the bypass flow path only, such that when circulating in the closed-loop circulating flow path, the liquid substantially only circulates in the supply path and the bypass path, wherein the closed-loop circulating flow path is configured such that the plurality of bypass flow paths does not straddle between the two supply flow paths with respect to any set of two supply flow paths among three or more supply flow paths.

* * * * *